US009827792B2

(12) United States Patent
Soda et al.

(10) Patent No.: US 9,827,792 B2
(45) Date of Patent: Nov. 28, 2017

(54) INKJET RECORDING APPARATUS

(71) Applicant: KYOCERA Document Solutions Inc., Osaka (JP)

(72) Inventors: Tomohisa Soda, Osaka (JP); Hiroatsu Tamai, Osaka (JP); Takeshi Watanabe, Osaka (JP); Jumpei Hobo, Osaka (JP); Shinji Yoshinaga, Osaka (JP); Hidenori Takenaka, Osaka (JP); Satoshi Tsunemi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/058,404

(22) Filed: Mar. 2, 2016

(65) Prior Publication Data

US 2016/0257142 A1 Sep. 8, 2016

(30) Foreign Application Priority Data

Mar. 6, 2015 (JP) ..... 2015-044933
Mar. 13, 2015 (JP) ..... 2015-051019

(51) Int. Cl.
*B41J 2/17* (2006.01)
*B41J 13/08* (2006.01)
(Continued)

(52) U.S. Cl.
CPC ..... *B41J 11/0085* (2013.01); *B41J 2/1714* (2013.01); *B41J 11/007* (2013.01); *B41J 13/08* (2013.01); *B41J 29/377* (2013.01)

(58) Field of Classification Search
CPC ..... B41J 2/1714
See application file for complete search history.

(56) References Cited

U.S. PATENT DOCUMENTS 5,519,420 A * 5/1996 Zorn ..... B41J 29/12 347/25
7,384,122 B2 6/2008 Shimizu
(Continued)

FOREIGN PATENT DOCUMENTS

JP 09034199 A * 2/1997
JP 2003220695 A * 8/2003
(Continued)

OTHER PUBLICATIONS

Machine generated English translation of JP2003-220695 to Umeda, "Ink Jet Recording Apparatus"; obtained via https://www.j-platpat.inpit.go.jp/web/all/top/BTmTopEnglishPage on Dec. 21, 2016; 6pp.*
(Continued)

*Primary Examiner* — Shelby Fidler
(74) *Attorney, Agent, or Firm* — Studebaker & Brackett PC

(57) ABSTRACT

An inkjet recording apparatus includes a sheet feed section, an image forming section, a partition unit, an air inflow portion, a first sheet conveyance section, a second sheet conveyance section, and an air sucking and discharging section. The partition unit partitions an interior of an apparatus casing into a first space in which the image forming section is disposed and a second space in which the sheet feed section, the first sheet conveyance section, and the second sheet conveyance section are disposed. Air outside the apparatus casing is taken into the first space through the air inflow portion. The second sheet conveyance section includes a conveyance guide disposed downstream of the image forming section in a conveyance direction of a recording sheet. The air sucking and discharging section sucks air around the conveyance guide and discharges the air into the second space or out of the apparatus casing.

6 Claims, 16 Drawing Sheets

(51) Int. Cl.
*B41J 11/00* (2006.01)
*B41J 29/377* (2006.01)

(56) References Cited

U.S. PATENT DOCUMENTS

| | | | | |
|---|---|---|---|---|
| 2005/0122372 | A1* | 6/2005 | Shimizu | B41J 11/007 347/22 |
| 2006/0023021 | A1* | 2/2006 | Shimizu | B41J 11/007 347/34 |
| 2009/0244247 | A1* | 10/2009 | Yamamoto | B41J 11/007 347/104 |
| 2011/0109682 | A1* | 5/2011 | Kitai | B41J 11/002 347/16 |
| 2011/0221845 | A1* | 9/2011 | Ue | B41J 11/0085 347/104 |

FOREIGN PATENT DOCUMENTS

| | | | | |
|---|---|---|---|---|
| JP | 2006-043889 | A | 2/2006 | |
| JP | 4591463 | B2 * | 12/2010 | B41J 2/1714 |
| JP | 2012183649 | A * | 9/2012 | |

OTHER PUBLICATIONS

Machine generated Ensligh translatino of JP09-034199 to Nakamura, “Copying Device”; obtained via https://www.j-platpat.inpit.go.jp/web/all/top/BTmTopEnglishPage on Dec. 21, 2016; 3pp.*

* cited by examiner

INKJET RECORDING APPARATUS

INCORPORATION BY REFERENCE

The present application claims priority under 35 U.S.C. §119 to Japanese Patent Application Nos. 2015-044933 filed on Mar. 6, 2015 and 2015-051019, filed on Mar. 13, 2015. The contents of these applications are incorporated herein by reference in their entirety.

BACKGROUND

The present disclosure relates to inkjet recording apparatuses.

A typical inkjet recording apparatus ejects ink onto a recording medium. In order to prevent nozzle clogging in recording heads of the inkjet recording apparatus, various techniques have been proposed to prevent attachment of paper dust to the recording heads.

For example, an inkjet recording apparatus has been known in which a partition plate separates a sheet feed section from a space around the recording heads. In the inkjet recording apparatus, a fan unit equipped with a filter sends clean air to the space around the recording heads.

Paper dust entering the space around the recording heads can be reduced to a minimum in the inkjet recording apparatus.

SUMMARY

An inkjet recording apparatus according to the present disclosure forms an image by ejecting ink onto a recording medium. The inkjet recording apparatus includes an image forming section, a sheet feed section, a first sheet conveyance section, a second sheet conveyance section, a casing, a partition unit, and an air inflow portion. The image forming section forms an image by ejecting ink onto the recording medium while conveying the recording medium. The sheet feed section stores therein the recording medium and feeds the recording medium. The first sheet conveyance section conveys the recording medium fed from the sheet feed section toward the image forming section. The second sheet conveyance section conveys the recording medium conveyed from the image forming section to eject the recording medium out of the inkjet recording apparatus. The casing houses the image forming section, the first sheet conveyance section, the second sheet conveyance section, and the sheet feed section. The partition unit partitions an interior of the casing into a first space in which the image forming section is disposed and a second space in which the sheet feed section, the first sheet conveyance section, and the second sheet conveyance section are disposed. Through the air inflow portion, air outside the casing is taken into the first space. The second sheet conveyance section includes a conveyance guide disposed downstream of the image forming section in a conveyance direction of the recording medium. The image forming section includes a placement roller disposed in a vicinity of an upstream end of the image forming section in the conveyance direction of the recording medium. The inkjet recording apparatus further includes a sucking and discharging section configured to suck air around either or both the conveyance guide and the placement roller and discharge the air into the second space or outside the casing.

DETAILED DESCRIPTION

Figure 1:
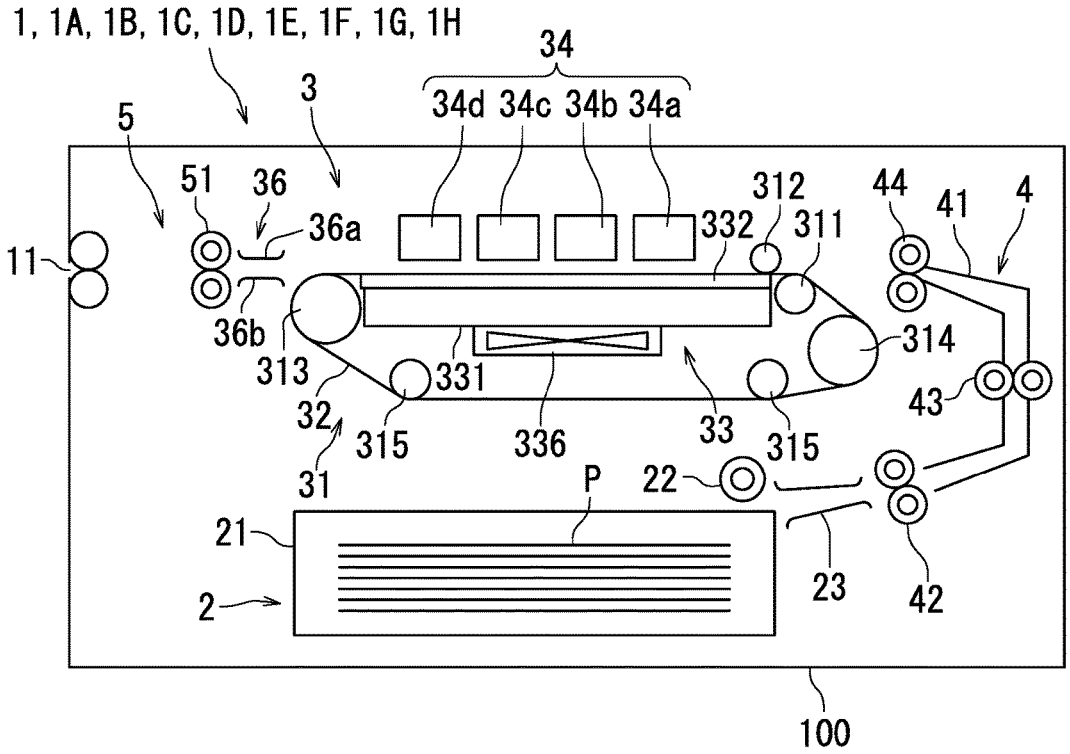
FIG. 1 is a diagram illustrating a configuration of an inkjet recording apparatus according to embodiments of the present disclosure.

The following describes embodiments of the present disclosure with reference to the accompanying drawings (FIGS. 1-16). Like numerals denote like elements or corresponding elements in the drawings, and description thereof is not repeated.

An inkjet recording apparatus 1 (1A, 1B, 1C, 1D, 1E, 1F, 1G and 1H) according to respective embodiments will be described first with reference to FIG. 1. FIG. 1 illustrates a configuration of the inkjet recording apparatus 1 (1A, 1B, 1C, 1D, 1E, 1F, 1G; and 1H) according to the respective embodiments. The inkjet recording apparatus 1 (1A, 1B, 1C, 1D, 1E, 1F, 1G and 1H) includes an apparatus casing 100, a sheet feed section 2 disposed in a lower part of the apparatus casing 100, an image forming section 3 disposed above the sheet feed section 2, a sheet conveyance section 4 disposed on one side (right side in FIG. 1) of the image forming section 3, and a sheet ejecting section 5 disposed on the other side (left side in FIG. 1) of the image forming section 3.

The sheet feed section 2 includes a sheet feed cassette 21, a sheet feed roller 22, and a guide plate 23. The sheet feed cassette 21 is for storing recording sheets P and is attachable to and detachable from the apparatus casing 100. The sheet feed roller 22 is disposed above one side end (right side end in FIG. 1) of the sheet feed cassette 21. The guide plate 23 is disposed between the sheet feed roller 22 and the sheet conveyance section 4.

The sheet feed cassette 21 stores therein a plurality of recording sheets P. Hereinafter, the recording sheets are referred to simply as a sheet. A recording sheet P corresponds to an example of a recording medium. The sheet feed roller (pickup roller) 22 feeds sheets P one at a time in a conveyance direction of the sheet P by picking up the uppermost sheet P among the sheets P stored in the sheet feed cassette 21. The guide plate 23 guides the sheet P picked up by the sheet feed roller 22 to the sheet conveyance section 4.

The sheet conveyance section 4 includes a substantially C-shaped sheet conveyance path 41, a pair of first conveyance rollers 42 disposed at the entry of the sheet conveyance path 41, a pair of second conveyance rollers 43 disposed at an intermediate location on the sheet conveyance path 41, and a pair of registration rollers 44 disposed at the exit of the sheet conveyance path 41.

The pair of first conveyance rollers 42 is a roller pair (a feed roller pair) that feeds a sheet P in the conveyance direction of the sheet P. The sheet P fed from the sheet feed section 2 is caught between the pair of first conveyance rollers 42 and forwarded to the sheet conveyance path 41. The pair of second conveyance rollers 43 is also a feed roller pair. The sheet P forwarded from the pair of first conveyance rollers 42 is caught between the pair of second conveyance rollers 43 and forwarded toward the pair of registration rollers 44.

The pair of registration rollers 44 performs skew correction on the sheet P conveyed by the pair of second conveyance rollers 43. The pair of registration rollers 44 temporarily holds the sheet P to synchronize the conveyance of the sheet P and image formation, and then feeds the sheet P to the image forming section 3 according to timing of the image formation.

The image forming section 3 includes a conveyor belt 32 and recording heads 34. The conveyor belt 32 conveys the sheet P fed from the pair of registration rollers 44 in a predetermined direction (leftward in FIG. 1). The recording heads 34 form an image on the sheet P being conveyed on the conveyor belt 32. Detailed structure of the image forming section 3 will be described later with reference to FIG. 2. The image forming section 3 additionally includes a pair of conveyance guides 36 located downstream (on the left in FIG. 1) of the recording heads 34 in the conveyance direction of the sheet P.

The pair of conveyance guides 36 guides the sheet P conveyed from the conveyor belt 32 to the sheet ejecting section 5. The sheet ejecting section 5 includes a pair of ejection rollers 51. As illustrated in FIG. 1, the pair of conveyance guides 36 includes two plate members of an upper conveyance guide 36*a* and a lower conveyance guide 36*b* disposed in parallel to the conveyance direction of the sheet P (horizontal direction in FIG. 1).

The pair of ejection rollers 51 feeds the sheet P having passed through the pair of conveyance guides 36 toward an exit port 11. The sheet P fed from the pair of ejection rollers 51 is ejected out of the apparatus casing 100 through the exit port 11 formed in a side wall of the apparatus casing 100 (a left side wall in FIG. 1).

Figure 2:
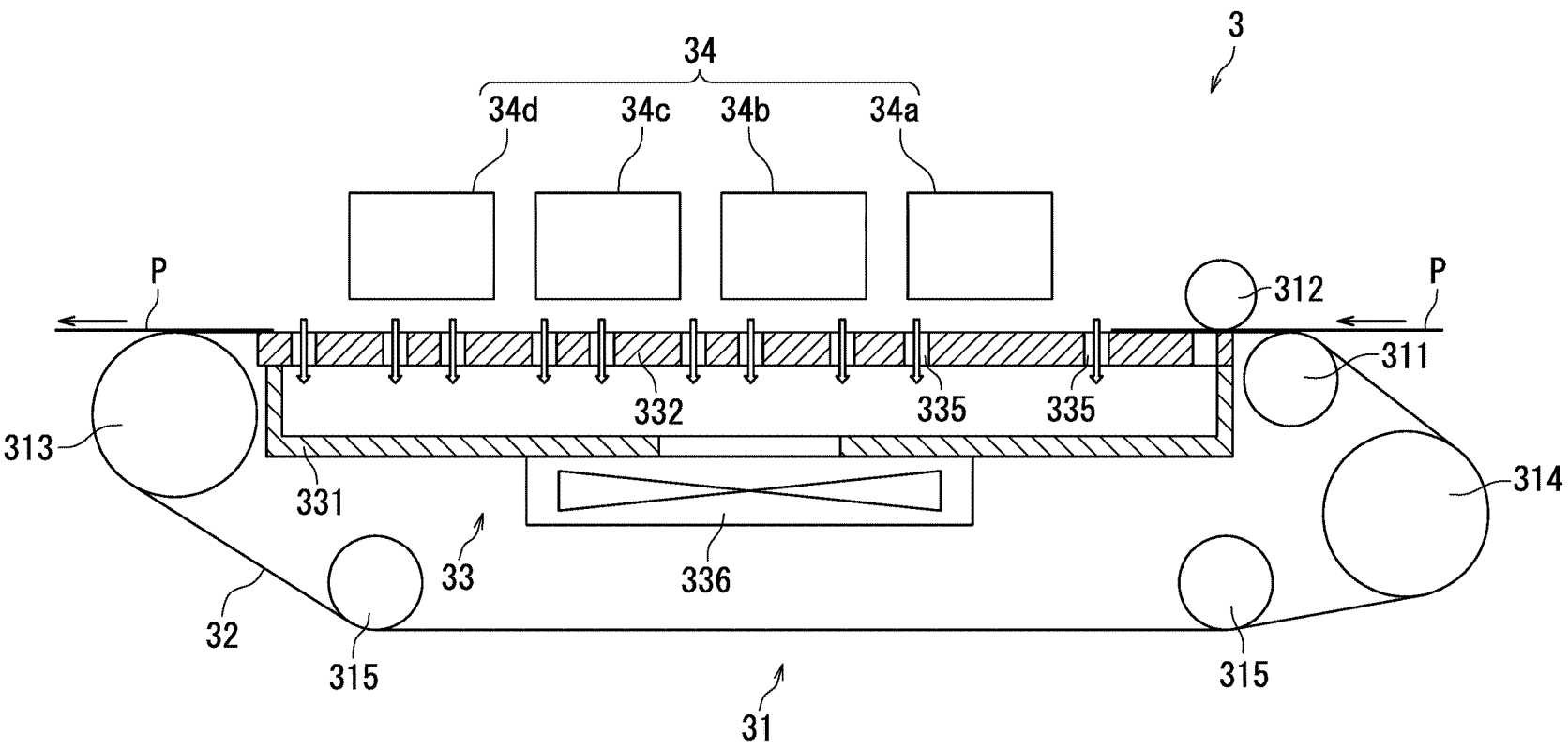
FIG. 2 illustrates structure of an image forming section illustrated in FIG. 1.

With reference to FIG. 2, the image forming section 3 will be described next. FIG. 2 illustrates the structure of the image forming section 3 illustrated in FIG. 1.

As illustrated in FIG. 2, the image forming section 3 includes a conveyance section 31, a negative pressure applying section 33, and the recording heads 34 (four types of recording heads 34*a*, 34*b*, 34*c*, and 34*d*). The four types of recording heads 34*a*, 34*b*, 34*c*, and 34*d* each include a plurality of nozzles (not illustrated). Ink is ejected through the plurality of nozzles so as to form images such as characters and figures on a sheet P. The recording heads 34*a*, 34*b*, 34*c*, and 34*d* are substantially identical in structure and may therefore be generally referred to as recording heads 34 without distinguishing therebetween.

The conveyance section 31 conveys the sheet P in a predetermined direction (leftward direction in FIG. 2). The conveyance section 31 includes a belt speed detecting roller 311, a placement roller 312, a drive roller 313, a tension roller 314, a pair of guide rollers 315, and the conveyor belt 32.

The conveyance section 31 is disposed opposite to the four types of recording heads 34 (34*a*, 34*b*, 34*c*, and 34*d*) in the apparatus casing 100. The conveyor belt 32 is wound around the belt speed detecting roller 311, the drive roller 313, the tension roller 314, and the pair of guide rollers 315. The conveyor belt 32 is circulated in the conveyance direction of the sheet P (counterclockwise direction in FIG. 2) to convey the sheet P.

The tension roller 314 applies tension to the conveyor belt 32 so as to ensure that the conveyor belt 32 does not sag.

The belt speed detecting roller 311 is disposed upstream (on right side in FIG. 2) of the negative pressure applying section 33 in the conveyance direction of the sheet P and rotates by friction with the conveyor belt 32. The belt speed detecting roller 311 includes a pulse plate (not illustrated) that integrally rotates with the belt speed detecting roller 311. The circulation speed of the conveyor belt 32 is measured by measuring the rotational speed of the pulse plate.

The drive roller 313 is disposed downstream (on left side in FIG. 1) of the negative pressure applying section 33 in the conveyance direction of the sheet P.

The drive roller 313 is driven to rotate by a motor (not illustrated) to circulate the conveyor belt 32 in counterclockwise direction in FIG. 2.

The pair of guide rollers 315 is disposed below the negative pressure applying section 33 to secure space below the negative pressure applying section 33. This arrangement of the pair of guide rollers 315 can prevent a portion of the conveyor belt 32 below the negative pressure applying section 33 from contacting the negative pressure applying section 33.

The four types of recording heads 34 (34*a*, 34*b*, 34*c*, and 34*d*) are arranged in parallel from upstream to downstream in the conveyance direction of the sheet P. The recording heads 34*a*, 34*b*, 34*c*, and 34*d* each include a plurality of nozzles (not illustrated) arranged in a width direction of the conveyor belt 32 (direction perpendicular to the drawing surface in FIG. 2). The recording heads 34*a*, 34*b*, 34*c*, and 34*d* are referred to as line type recording heads. That is, the inkjet recording apparatus 1 is a line head inkjet recording apparatus.

The negative pressure applying section 33 applies negative pressure to the sheet P through the conveyor belt 32, causing the sheet P to be sucked onto the conveyor belt 32. The negative pressure applying section 33 is disposed on the rear surface (underside in FIG. 2) of the conveyor belt 32 and opposite to the four types of recording heads 34 with the conveyor belt 32 therebetween. The negative pressure applying section 33 includes an airflow chamber 331, a guide member 332 covering an open top of the airflow chamber 331, and a negative pressure creating section 336.

The placement roller 312 is a driven roller. The placement roller 312 is disposed opposite to the guide member 332 with the conveyor belt 32 therebetween. The placement roller 312 guides the sheet P fed from the pair of registration rollers 44 onto the conveyor belt 32 so that the sheet P is sucked onto the conveyor belt 32.

The guide member 332 supports the sheet P through the conveyor belt 32. The guide member 332 has through holes 335.

For convenience, the present embodiment describes the guide member 332 as part of the negative pressure applying section 33. Alternatively, however, the guide member 332 may be described as part of the conveyance section 31 because the guide member 332 supports the conveyor belt 32 as described above.

The airflow chamber 331 is a box-shaped member that is a tube having an open top and a closed bottom. The airflow chamber 331 has side walls that are secured at the top to the guide member 332. The negative pressure creating section 336 is disposed below the airflow chamber 331. Through drive of the negative pressure creating section 336, negative pressure is created in the airflow chamber 331. The negative pressure acts on the sheet P through the guide member 332 and the conveyor belt 32 to suck the sheet P onto the conveyor belt 32.

The negative pressure creating section 336 creates negative pressure in the airflow chamber 331 and may be for example a fan.

Operation of the inkjet recording apparatus 1 will be described next with reference to FIG. 1. The sheet feed roller 22 picks up a sheet P from the sheet feed cassette 21. The picked sheet P is guided by the guide plate 23 to the pair of first conveyance rollers 42.

The sheet P is fed by the pair of first conveyance rollers 42 into the sheet conveyance path 41 and then conveyed by the pair of second conveyance rollers 43 in the conveyance direction of the sheet P. The sheet P comes to stop upon contact with the pair of registration rollers 44 to receive skew correction. The sheet P is then fed to the image forming section 3 by the pair of registration rollers 44 in accordance with timing of image formation.

The sheet P is guided onto the conveyor belt 32 by the placement roller 312 and allowed to be sucked on the conveyor belt 32. The sheet P covers a part of the suction holes 321 (see FIG. 3) located in the conveyor belt 32. The negative pressure applying section 33 sucks air through the guide member 332 and the conveyor belt 32 to create negative pressure in the airflow chamber 331. In the above configuration, the negative pressure acts on the sheet P such that the sheet P is sucked onto the conveyor belt 32. Then, the sheet P is conveyed in the conveyance direction of the sheet P as the conveyor belt 32 circulates.

The sheet P is then conveyed on the conveyor belt 32 sequentially to the regions opposite to the four types of recording heads 34*a*, 34*b*, 34*c*, and 34*d*. While the sheet P is conveyed on the conveyor belt 32, the four types of recording heads 34*a*, 34*b*, 34*c*, and 34*d* eject ink of respective colors toward the sheet P. Through the above, an image is formed on the sheet P.

The sheet P is conveyed from the conveyor belt 32 to the pair of conveyance guides 36. The sheet P having passed through the pair of conveyance guides 36 is fed toward the exit port 11 by the pair of ejection rollers 51 and ejected out of the apparatus casing 100 through the exit port 11.

Figure 3:
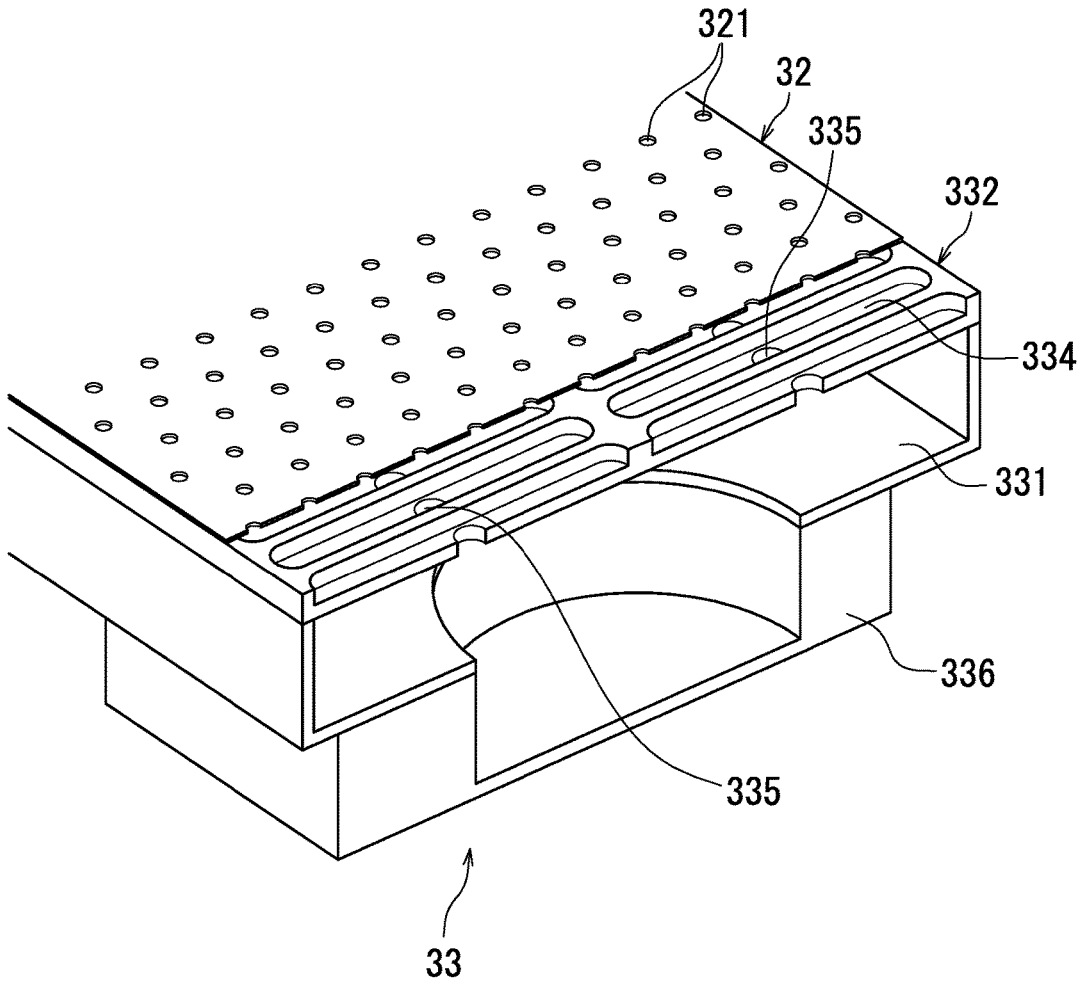
FIG. 3 is a cutaway perspective view illustrating structure of a conveyor belt, a guide member, and a negative pressure applying section illustrated in FIG. 2.

Description will be made next about structure of the conveyor belt 32, the guide member 332, and the negative pressure applying section 33 with reference to FIG. 3. FIG. 3 is a cutaway perspective view illustrating the structure of the conveyor belt 32, the guide member 332, and the negative pressure applying section 33 illustrated in FIG. 2.

As illustrated in FIG. 3, the conveyor belt 32, the guide member 332, the airflow chamber 331, and the negative pressure creating section 336 are disposed in order from up to down. The conveyor belt 32 has a plurality of suction holes 321.

The suction holes 321 in the conveyor belt 32 will be described here. As illustrated in FIG. 3, the conveyor belt 32 has the plurality of suction holes 321 located at substantially regular intervals.

A plurality of grooves 334 are located in the upper surface (surface on the side of the conveyor belt 32) of the guide member 332. The grooves 334 each have a shape of an oval elongated in the conveyance direction of the sheet P.

Figure 4:
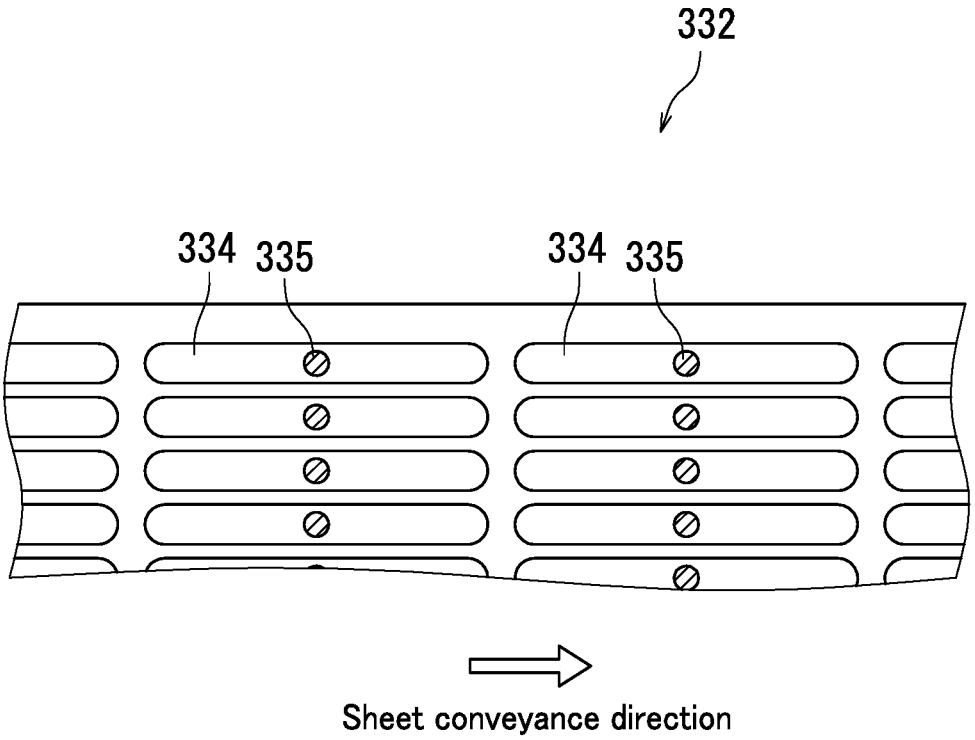
FIG. 4 is a plan view illustrating structure of the guide member illustrated in FIG. 3.

With reference to FIG. 4, the grooves 334 and the through holes 335 in the guide member 332 will be described next. FIG. 4 is a plan view illustrating structure of the guide member 332 illustrated in FIG. 3. As illustrated in FIG. 4, the guide member 332 has a plurality of rows of grooves 334 each having an oval shape elongated in the conveyance direction of the sheet P (horizontal direction in FIG. 5). The rows of the grooves 334 are arranged in a width direction of the guide member 332 (up-and-down direction in FIG. 4). Each groove 334 has a through hole 335 that penetrates the guide member 332 in the thickness direction thereof substantially at the center of the groove 334 in the conveyance direction of the sheet P (horizontal direction in FIG. 4). The through holes 335 each are substantially circular in cross section.

Figure 5A:
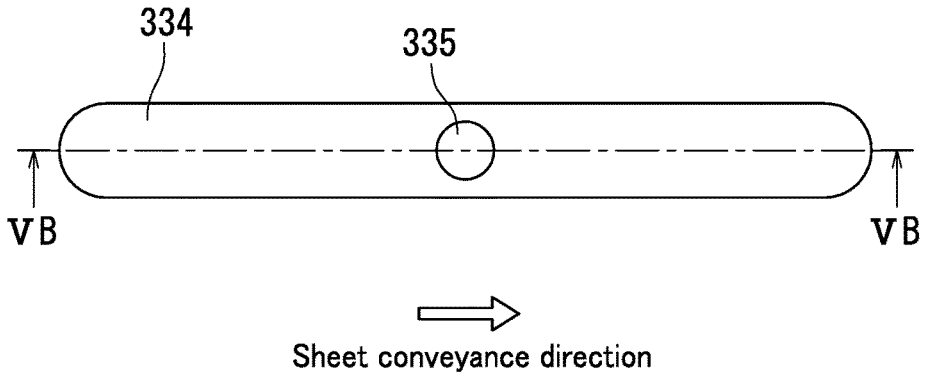
FIG. 5A is a plan view illustrating structure of a groove and a through hole located in the guide member illustrated in FIG. 3.
Figure 5B:
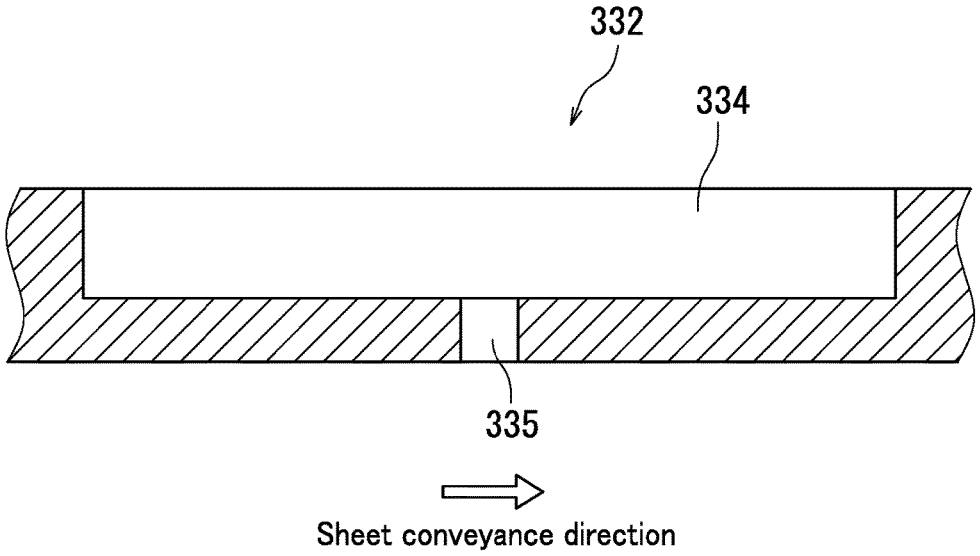
FIG. 5B is a cross sectional view of the groove and the through hole taken along the line VB-VB.

With reference next to FIGS. 5A and 5B, a groove 334 and a through hole 335 in the guide member 332 will be described next. FIG. 5A is a plan view illustrating structure of a groove 334 and a through hole 335 located in the guide member 332 illustrated in FIG. 3. FIG. 5B is a cross sectional view of the groove 334 and the through hole 335 in FIG. 5A taken along the line VB-VB in FIG. 5A.

As illustrated in FIG. 5A, the groove 334 has the through hole 335 that penetrates the guide member 332 in the thickness direction thereof substantially at the center of the groove 334 in the conveyance direction of the sheet P (horizontal direction in FIG. 5A). As illustrated in FIG. 5B, the groove 334 is in communication with the through hole 335 and therefore negative pressure applied from the airflow chamber 331 through the through hole 335 acts also on a region where the groove 334 is located.

Referring back to FIG. 3, description will be made about the positional relationship between the suction holes 321 in the conveyor belt 32 and the grooves 334 in the guide member 332. The conveyor belt 32 has a plurality of rows of the suction holes 321. The rows of the suction holes 321 are arranged in the conveyance direction of the sheet P next to one another in a width direction of the conveyor belt 32 (direction perpendicular to the conveyance direction of the sheet P) such that the suction holes 321 in adjacent rows are staggered. As illustrated in FIG. 3, the respective rows of the suction holes 321 in the conveyor belt 32 are located opposite to the rows of the grooves 334 in the guide member 332.

Each groove 334 is arranged so as to be opposite to at least two of the suction holes 321 at all times. The suction holes 321 that are opposite to the grooves 334 change one-by-one as the conveyor belt 32 circulates.

The airflow chamber 331, which is under negative pressure created by the negative pressure creating section 336, is in communication with the suction holes 321 in the conveyor belt 32 through the through holes 335 and the grooves 334 of the guide member 332.

As described above, the negative pressure is applied to the suction holes 321 of the conveyor belt 32 and thus the conveyor belt 32 can convey a sheet P with the sheet P sucked onto the conveyor belt 32.

Inkjet Recording Apparatus 1 According to First Embodiment

Figure 6:
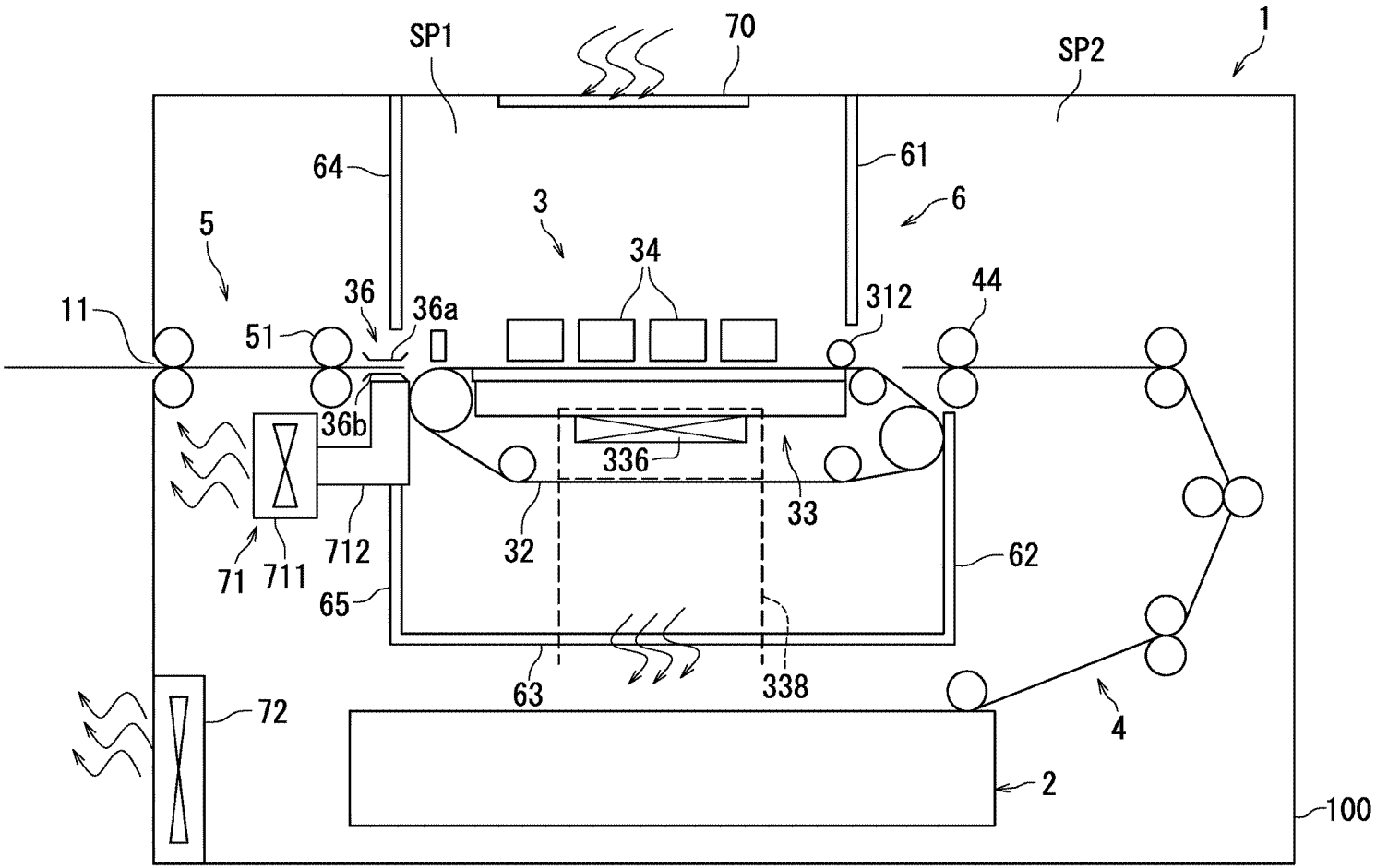
FIG. 6 is a side view illustrating an inkjet recording apparatus in FIG. 1 according to a first embodiment.

The following describes a configuration of an inkjet recording apparatus 1 according to a first embodiment with reference to FIG. 6. FIG. 6 is a side view illustrating the inkjet recording apparatus 1 in FIG. 1 according to the first embodiment. The inkjet recording apparatus 1 includes a partition unit 6, an air inflow portion 70, a duct 338, a first air sucking and discharging section 71, and a second air sucking and discharging section 72.

The partition unit 6 partitions an interior of the apparatus casing 100 into a first space SP1 and a second space SP2. The image forming section 3 is disposed in the first space SP1. The sheet feed section 2, the sheet conveyance section 4, and the sheet ejecting section 5 are disposed in the second space SP2. The sheet conveyance section 4 corresponds to an example of a first sheet conveyance section. The sheet ejecting section 5 corresponds to an example of a second sheet conveyance section. The partition unit 6 includes a first partition plate 61, a second partition plate 62, a third partition plate 63, a fourth partition plate 64, and a fifth partition plate 65.

The first partition plate 61 is a flat plate member that extends from a location above the placement roller 312 to an upper wall of the apparatus casing 100. The second partition plate 62 is a flat plate member that extends from a location below the pair of registration rollers 44 to a location above the sheet feed section 2. The third partition plate 63 is a flat plate member that has one side end (right end in FIG. 6) connected to a lower end of the second partition plate 62 and the other side end (left end in FIG. 6) connected to a lower end of the fifth partition plate 65.

The fourth partition plate 64 is a flat plate member that extends from a location above an upstream end (right side end in FIG. 6) of the pair of conveyance guides 36 in the conveyance direction of the sheet P to the upper wall of the apparatus casing 100. The fifth partition plate 65 is a flat plate member that extends from a location blow the upstream end (right side end in FIG. 6) of the pair of conveyance guides 36 in the conveyance direction of the sheet P to a location above the sheet feed section 2.

The air inflow portion 70 is located between a location where the upper wall of the apparatus casing 100 is connected to the upper end of the first partition plate 61 and a location where the upper wall of the apparatus casing 100 is connected to the upper end of the fourth partition plate 64. Air outside the apparatus casing 100 is taken into the first space SP1 through the air inflow portion 70. The air inflow portion 70 includes a filter (not illustrated) to remove dust in air that is to be introduced into the first space SP1 from the outside of the apparatus casing 100.

The duct 338 releases exhaust gas from the negative pressure creating section 336 into the second space SP2. In FIG. 6, the duct 338 extends downward through the third partition plate 63 from the negative pressure creating section 336 to a location below the third partition plate 63. The duct 338 detours around the conveyor belt 32 in front of (or behind) the drawing surface in FIG. 6 so as not to interfere with the conveyor belt 32.

The first air sucking and discharging section 71 sucks air around the pair of conveyance guides 36 and discharges the air into the second space SP2. The first air sucking and discharging section includes a fan 711 and a duct 712. The fan 711 sucks air in the duct 712 and discharges the air into the second space SP2. The duct 712 forms an air flow path between the fan 711 and the lower conveyance guide 36*b* so that air around the pair of conveyance guides 36 is sucked by the fan 711. The lower conveyance guide 36*b* has air holes 361 as will be described later with reference to FIG. 7.

FIG. 6 illustrates a configuration in which the first air sucking and discharging section 71 sucks air around the lower conveyance guide 36*b*. However, another configuration may be employed. For example, the first air sucking and discharging section 71 may suck air around the upper conveyance guide 36*a*. Alternatively, the first air sucking and discharging section 71 may suck air around the upper conveyance guide 36*a* and the lower conveyance guide 36*b*. The above configuration can suck paper dust generated at the pair of conveyance guides 36 further efficiently.

The second air sucking and discharging section 72 discharges air in the second space SP2 out of the apparatus casing 100. The second air sucking and discharging section 72 is disposed at the side wall of the apparatus casing 100 below the exit port 11.

FIG. 6 illustrates a configuration in which the second air sucking and discharging section 72 is disposed at the side wall of the apparatus casing 100 below the exit port 11. However, the second air sucking and discharging section 72 may be disposed at another location. For example, the second air sucking and discharging section 72 may be disposed opposite to the fan 711 of the first air sucking and discharging section 71 at the side wall of the apparatus casing 100. The above configuration can discharge paper dust generated at the pair of conveyance guides 36 out of the apparatus casing 100 further effectively.

As described above, the partition unit 6 partitions the interior of the apparatus casing 100 into the first space SP1 and the second space SP2. Air from which dust is removed is taken into the first space SP1 from the outside of the apparatus casing 100 through the air inflow portion 70. The first air sucking and discharging section 71 discharges paper dust generated at the pair of conveyance guides 36 into the second space SP2. In the above configuration, a state in which the first space SP1 contains less paper dust can be kept. Accordingly, a situation in which paper dust is attached to the recording heads 34 can be prevented.

The duct 338 releases exhaust gas from the negative pressure creating section 336 into the second space SP2. In the above configuration, paper dust collected by the negative pressure creating section 336 can be discharged into the second space SP2. Accordingly, it can be ensured that a situation in which paper dust is attached to the recording heads 34 is prevented.

In addition, the second air sucking and discharging section 72 discharges air in the second space SP2 out of the apparatus casing 100 such that paper dust in the second space SP2 is discharged out of the apparatus casing 100. In the above configuration, even if air in the second space SP2 enters the first space SP1, occurrence of a situation in which paper dust enters the first space SP1 can be reduced. Accordingly, it can be ensured that a situation in which paper dust is attached to the recording heads 34 is prevented.

Figure 7:
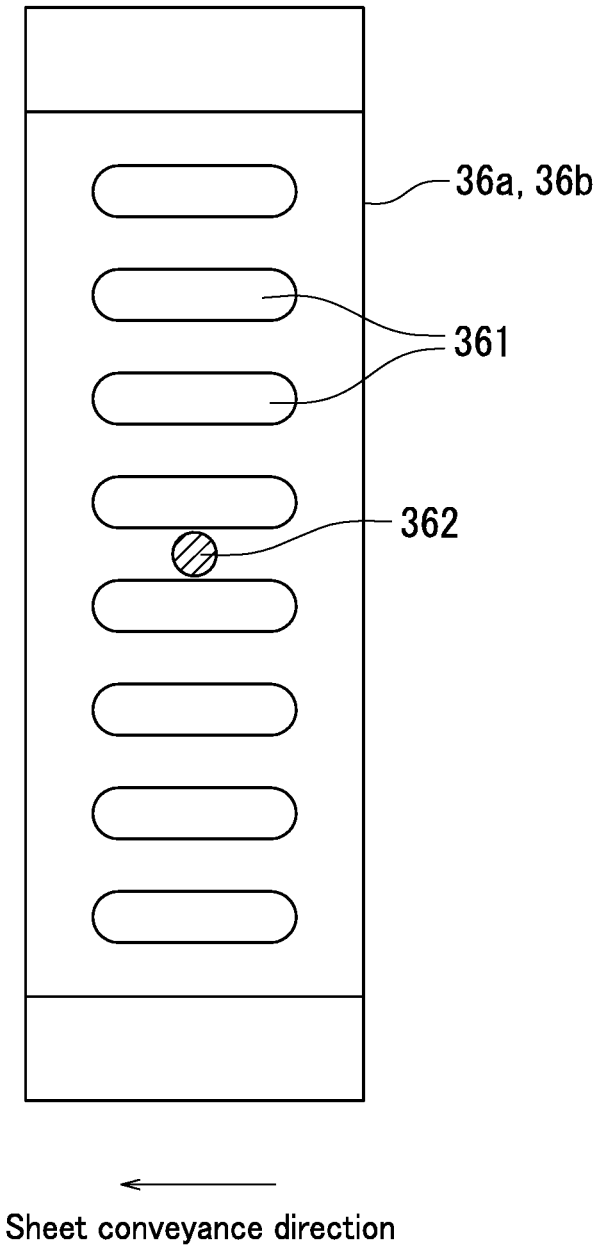
FIG. 7 is a plan view illustrating structure of a lower conveyance guide illustrated in FIG. 6.

Structure of the lower conveyance guide 36*b* will be described next with reference to FIG. 7. FIG. 7 is a plan view illustrating the structure of the lower conveyance guide 36*b* illustrated in FIG. 6. The lower conveyance guide 36*b* has the air holes 361 and includes a vibration applying section 362. The air holes 361 each are an elongated circular hole penetrating the lower conveyance guide 36*b* in the thickness direction thereof. The air holes 361 are arranged in a width direction of the lower conveyance guide 36*b* (up-and-down direction in FIG. 7). Through the air holes 361, air around the pair of conveyance guides 36 is sucked by the first air sucking and discharging section 71 illustrated in FIG. 6.

As described above, the lower conveyance guide 36*b* has the air holes 361. As a result, the first air sucking and discharging section 71 can further efficiently suck air around the pair of conveyance guides 36.

The vibration applying section 362 is disposed substantially at a center of the lower conveyance guide 36*b* to apply vibration to the lower conveyance guide 36*b*. The vibration applying section 362 is a vibrator including a motor with a shaft to which a weight is mounted such that the center of gravity of the shaft is eccentric. Through rotation of the motor, vibration is generated.

In a configuration in which the lower conveyance guide 36*b* includes the vibration applying section 362 as described above, a situation in which paper dust is attached to the pair of conveyance guides 36 can be prevented. As a result, paper dust generated at the pair of conveyance guides 36 can be sucked by the first paper dust air sucking and discharging section 71 further efficiently.

FIG. 6 illustrates the configuration in which the lower conveyance guide 36*b* has the air holes 361. In another configuration, the upper conveyance guide 36*a* may have air holes 361 in addition. In the above configuration, the first air sucking and discharging section 71 can suck air over a further wide area around the pair of conveyance guides 36.

FIG. 6 illustrates the configuration in which the lower conveyance guide 36*b* includes the vibration applying section 362. In another configuration, the upper conveyance guide 36*a* may include a vibration applying section 362 in addition. In the above configuration, it can be ensured that a situation in which paper dust is attached to the pair of conveyance guides 36 is prevented. Accordingly, paper dust generated at the pair of conveyance guides 36 can be further efficiently sucked by the first air sucking and discharging section 71.

Inkjet Recording Apparatus 1A According to Second Embodiment

Figure 8:
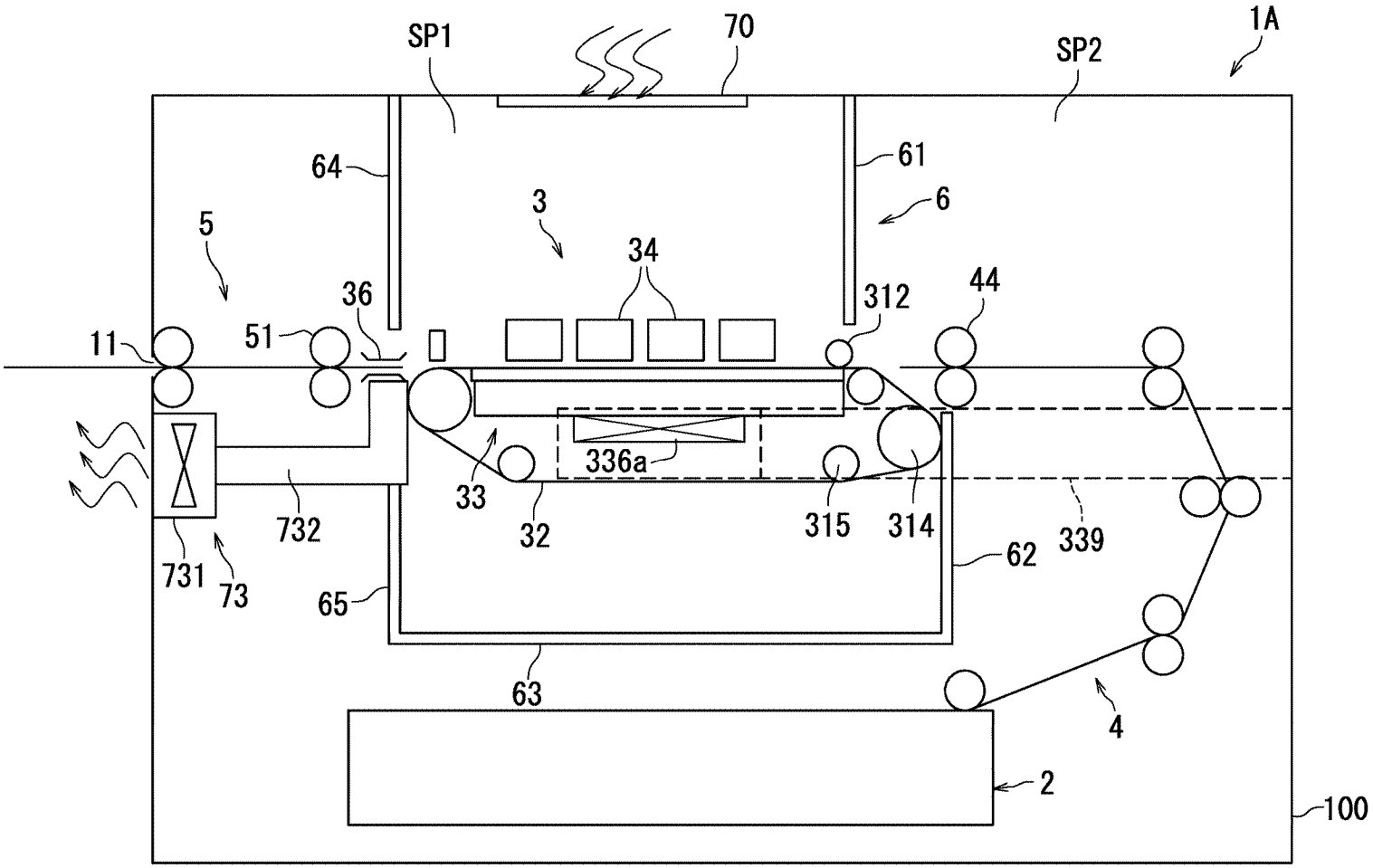
FIG. 8 is a side view illustrating an inkjet recording apparatus in FIG. 1 according to a second embodiment.

The following describes a configuration of an inkjet recording apparatus 1A according to a second embodiment with reference to FIG. 8. FIG. 8 is a side view illustrating the inkjet recording apparatus 1A in FIG. 1 according to the second embodiment. The inkjet recording apparatus 1A according to the second embodiment is different from the inkjet recording apparatus 1 according to the first embodiment in FIG. 6 in the following three aspects.

Difference A: A first air sucking and discharging section 73 discharges air around the pair of conveyance guides 36 out of the apparatus casing 100.

Difference B: A duct 339 releases exhaust gas from the negative pressure creating section 336*a* out of the apparatus casing 100.

Deference C: The second air sucking and discharging section 72 is not provided.

Elements of the inkjet recording apparatus 1A according to the second embodiment that are the same as those of the inkjet recording apparatus 1 according to the first embodiment illustrated in FIG. 6 are indicated by the same reference signs, and description thereof is not repeated. Description will be made below about elements of the inkjet recording apparatus 1A different from those of the inkjet recording apparatus 1. The inkjet recording apparatus 1A includes the duct 339 and the first air sucking and discharging section 73.

The duct 339 releases exhaust gas from the negative pressure creating section 336*a* out of the apparatus casing 100. The duct 339 extends rightward through the second partition plate 62 from the negative pressure creating section 336*a* to a right side wall of the apparatus casing 100. The duct 339 detours around the conveyor belt 32, the tension roller 314, and the pair of guide rollers 315 in front of (or behind) the drawing surface in FIG. 8 so as not to interfere with the conveyor belt 32, the tension roller 314, and the pair of guide rollers 315.

Figure 9:
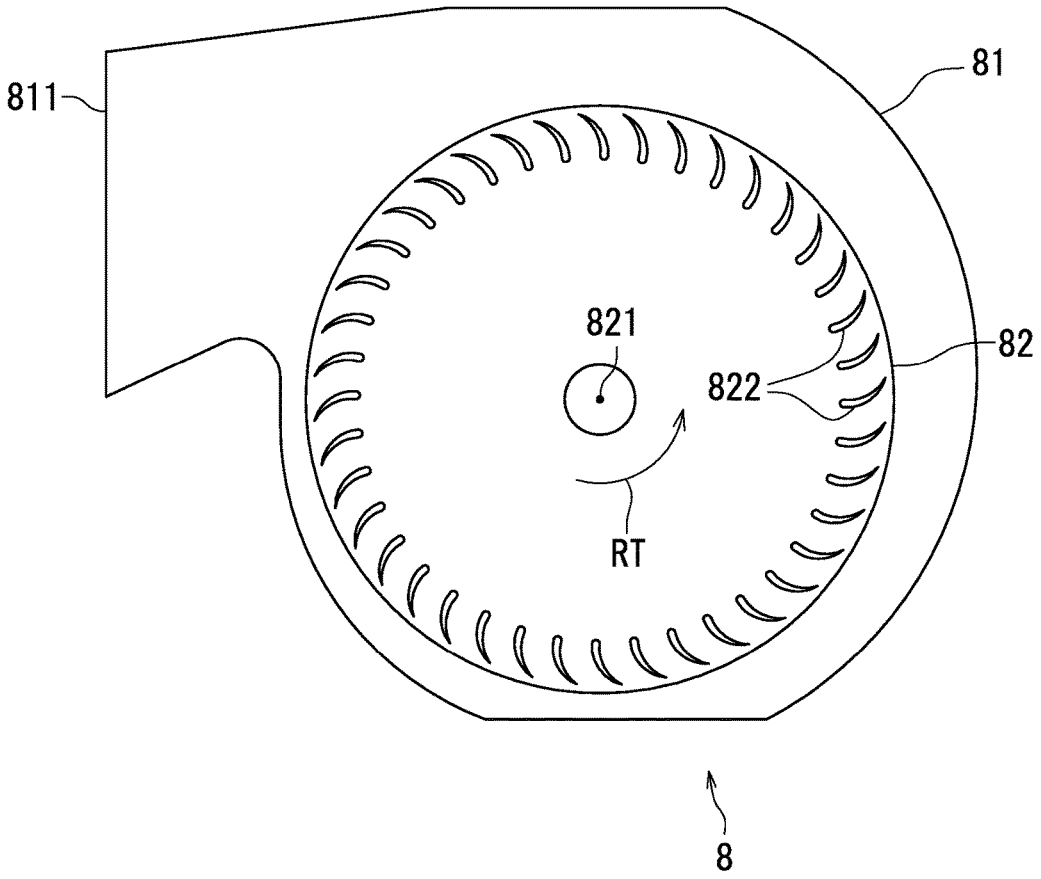
FIG. 9 is a plan view illustrating structure of a centrifugal fan illustrated in FIG. 8.

The negative pressure creating section 336*a* includes a centrifugal fan 8 illustrated in FIG. 9 for sucking air from above and discharging the air in the front of (or behind or right in) the drawing surface in FIG. 8. Structure of the centrifugal fan 8 will be describe later in detail with reference to FIG. 9.

Although a description is made with reference to FIG. 8 about a configuration in which the duct 339 releases air out of the apparatus casing 100 through the right side wall thereof, the duct 339 may release air through another part of the apparatus casing 100. For example, the duct 339 may release air through a left side wall of the apparatus casing 100. In the above configuration, air is discharged through the same side wall as the side wall through which air is discharged by the first air sucking and discharging section 73. Accordingly, paper dust contained in the discharged air can be easily collected outside the apparatus casing 100.

The first air sucking and discharging section 73 sucks air around the pair of conveyance guides 36 and discharges the air out of the apparatus casing 100. The first air sucking and discharging section 73 includes a fan 731 and a duct 732. The fan 731 sucks air in the duct 732 and discharges the air out of the apparatus casing 100. The duct 732 forms an air flow path between the fan 731 and the lower conveyance guide 36*b* so that the fan 731 sucks air around the pair of conveyance guides 36. The lower conveyance guide 36*b* has the air holes 361 as described with reference to FIG. 7.

In the above configuration, the duct 339 releases exhaust gas from the negative pressure creating section 336 out of the apparatus casing 100. In the above configuration, paper dust collected by the negative pressure creating section 336 can be discharged out of the apparatus casing 100. Accordingly, it can be ensured that a situation in which paper dust is attached to the recording heads 34 is prevented.

In the configuration as above in which the duct 339 releases exhaust gas from the negative pressure creating section 336 out of the apparatus casing 100, no paper dust is discharged into the second space SP2. This can suppress an increase in paper dust remaining in the second space SP2. Accordingly, it can be ensured that a situation in which paper dust is attached to the recording heads 34 is prevented.

The first air sucking and discharging section 73 discharges paper dust generated at the pair of conveyance guides 36 out of the apparatus casing 100. In the above configuration, the first space SP1 can be kept clean with less paper dust contained. Accordingly, a situation in which paper dust is attached to the recording heads 34 can be prevented.

In the configuration in which the first air sucking and discharging section 73 discharges paper dust generated at the pair of conveyance guides 36 out of the apparatus casing 100, no paper dust is discharged into the second space SP2. This can suppress an increase in paper dust remaining in the second space SP2. Accordingly, a situation in which paper dust is attached to the recording heads 34 can be prevented.

With reference to FIG. 9, the centrifugal fan 8 of the negative pressure creating section 336 will be described next. FIG. 9 is a plan view illustrating structure of the centrifugal fan 8. The centrifugal fan 8 includes a housing 81 and a vane supporting portion 82. The housing 81 houses the vane supporting portion 82 and has an exhaust port 811. The exhaust port 811 is an opening through which exhaust gas is discharged. The vane supporting portion 82 rotates about a central point 821 as a center in a direction indicated by an arrow RT (counterclockwise direction in FIG. 9) by a motor not illustrated. Multiple vanes 822 are disposed along a circumference that has the central point 821 as a center. The vanes 822 are configured such as to suck air in front of the drawing surface and discharges the air in the direction away from the central point 821.

When the vanes 822 of the centrifugal fan 8 circulate about the central point 821 as a center in the direction indicated by the arrow RT, air in front of the drawing surface in FIG. 9 is sucked and discharged in the direction away from the central point 821. The air discharged in the direction away from the central point 821 flows along the inner surface of the housing 81 and is then discharged through the exhaust port 811.

Inkjet Recording Apparatus 1B According to Third Embodiment

Figure 10:
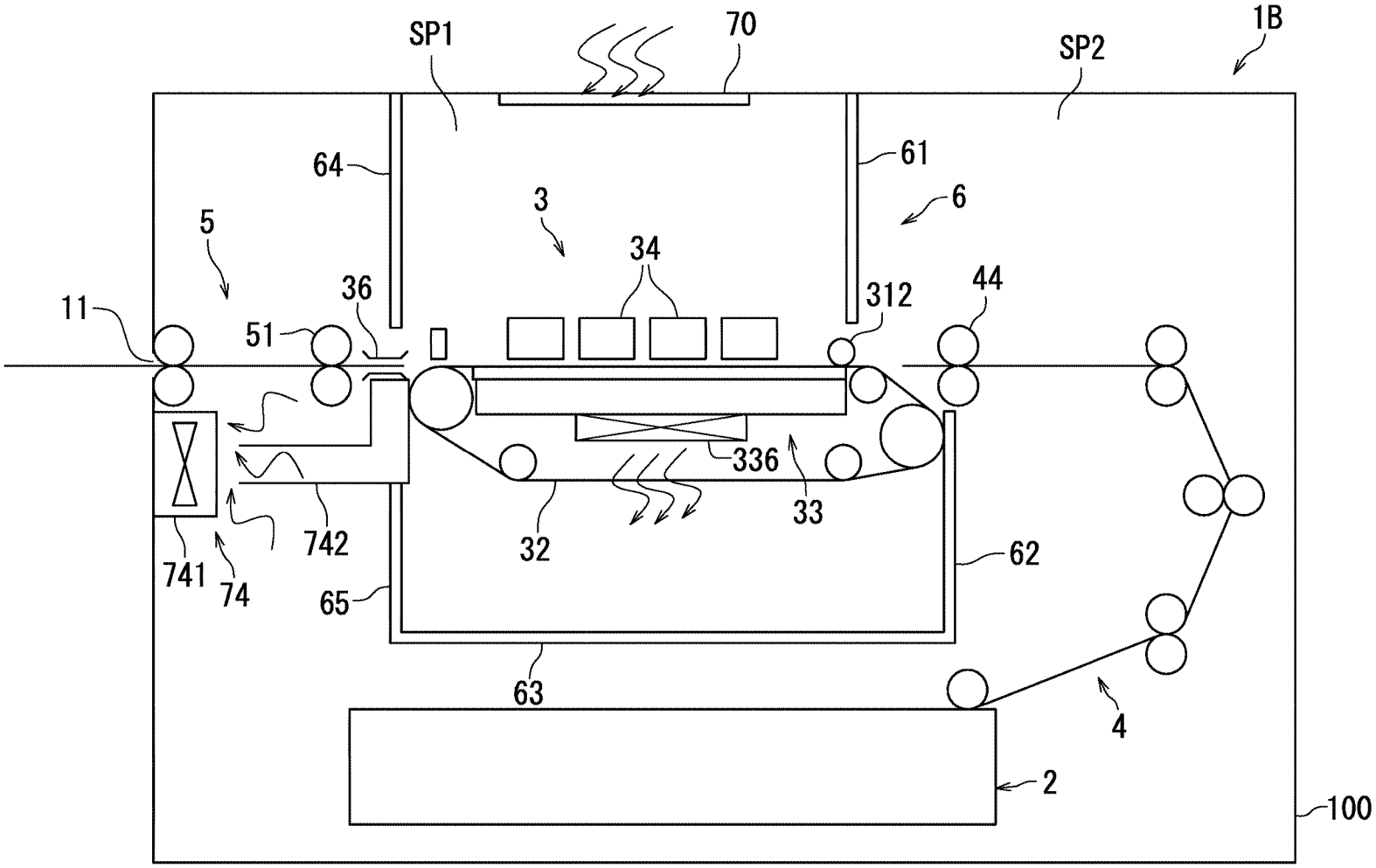
FIG. 10 is a side view illustrating an inkjet recording apparatus in FIG. 1 according to a third embodiment.

The following describes a configuration of the inkjet recording apparatus 1B according to a third embodiment with reference to FIG. 10. FIG. 10 is a side view illustrating the inkjet recording apparatus 1B in FIG. 1 according to the third embodiment. The inkjet recording apparatus 1B according to the third embodiment is different from the inkjet recording apparatus 1A according to the second embodiment in FIG. 8 in the following two aspects.

Difference D: A first air sucking and discharging section 74 discharges out of the apparatus casing 100, air in the second space SP2 in addition to air around the pair of conveyance guides 36.

Deference E: Exhaust gas from the negative pressure creating section 336 is discharged into the first space SP1.

Elements of the inkjet recording apparatus 1B according to the third embodiment that are the same as those of the inkjet recording apparatus 1A according to the second embodiment illustrated in FIG. 8 are indicated by the same reference signs, and description thereof is not repeated. Description will be made below about elements of the inkjet recording apparatus 1B different from those of the inkjet recording apparatus 1A.

The first air sucking and discharging section 74 sucks air around the pair of conveyance guides 36 and around the first air sucking and discharging section 74 in the second space SP2 and discharges the air out of the apparatus casing 100. The first air sucking and discharging section 74 includes a fan 741 and a duct 742. The fan 741 sucks air in the duct 742 and around the fan 741 in the second space SP2 and discharges the air out of the apparatus casing 100. The duct 742 forms an air flow path between a vicinity of the fan 741 and the lower conveyance guide 36*b* so as to allow the fan 741 to suck air around the pair of conveyance guides 36. The lower conveyance guide 36*b* has air holes 361 as described with reference to FIG. 7.

As described above, paper dust generated at the pair of conveyance guides 36 is discharged out of the apparatus casing 100 by the first air sucking and discharging section 74. Through the above, the first space SP1 can be kept clean with less paper dust contained. Accordingly, a situation in which paper dust is attached to the recording heads 34 can be prevented.

The first air sucking and discharging section 74 also discharges air in the second space SP2 out of the apparatus casing 100. In the above configuration, the second space SP2 can be kept clean with less paper dust contained. Accordingly, a situation in which paper dust is attached to the recording heads 34 can be prevented.

In addition, exhaust gas from the negative pressure creating section 336 is discharged into the first space SP1 with no additional duct. This can simplify the configuration of the inkjet recording apparatus 1B without need of a duct.

Inkjet Recording Apparatus According 1C to Fourth Embodiment

Figure 11:
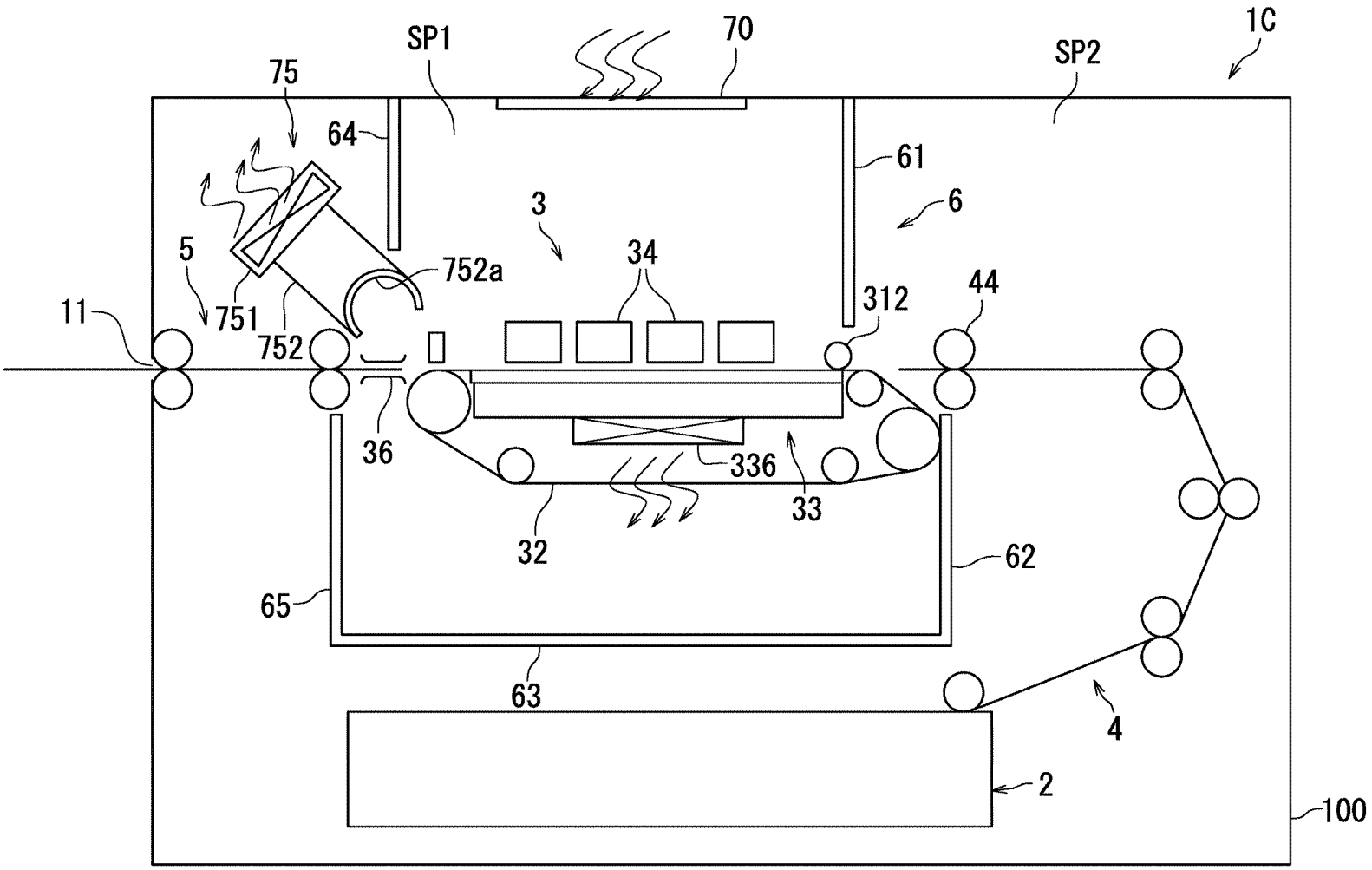
FIG. 11 is a side view illustrating an inkjet recording apparatus in FIG. 1 according to a fourth embodiment.

The following describes a configuration of the inkjet recording apparatus 1C according to a fourth embodiment with reference to FIG. 11. FIG. 11 is a side view illustrating the inkjet recording apparatus 1C in FIG. 1 according to the fourth embodiment. The inkjet recording apparatus 1C according to the fourth embodiment is different from the inkjet recording apparatus 1B according to the third embodiment in FIG. 10 in the following aspect.

Difference F: A first air sucking and discharging section 75 discharges air around an upper side of the pair of conveyance guides 36 into the second space SP2.

Elements of the inkjet recording apparatus 1C according to the fourth embodiment that are the same as those in the inkjet recording apparatus 1B according to the third embodiment illustrated in FIG. 10 are indicated by the same reference signs, and description thereof is not repeated. Description will be made below about elements of the inkjet recording apparatus 1C different from those of the inkjet recording apparatus 1B.

The first air sucking and discharging section 75 sucks air around the upper side of the pair of conveyance guides 36 and discharges the air into the second space SP2. The air sucking and discharging section 75 includes a fan 751 and a duct 752. The fan 751 sucks air in the duct 752 and discharges the air into the second space SP2. The duct 752 forms an air flow path between the fan 751 and a vicinity of the upper conveyance guide 36*a* so as to allow the fan 751 to suck air around the upper side of the pair of conveyance guides 36. The upper conveyance guide 36*a* has air holes 361 as described with reference to FIG. 7. The duct 752 has an opening 752*a*. The opening 752*a* has a shape suitable for sucking air around the upper conveyance guide 36*a*.

In the above configuration, air around the upper side of the pair of conveyance guides 36 is sucked and discharged into the second space SP2 by the first air sucking and discharging section 75. Through the above, it can be ensured that the paper dust generated at the pair of conveyance guides 36 is discharged into the second space SP2. Accordingly, a situation in which paper dust is attached to the recording heads 34 can be prevented.

A configuration in which the first air sucking and discharging section 75 discharges paper dust into the second space SP2 is described with reference to FIG. 11. Alternatively, the first air sucking and discharging section 75 may discharge paper dust out of the apparatus casing 100. In the above configuration, paper dust in the second space SP2 can be reduced. Accordingly, it can be ensured that a situation in which paper dust is attached to the recording heads 34 is prevented.

Inkjet Recording Apparatus 1D According to Fifth Embodiment

Figure 12:
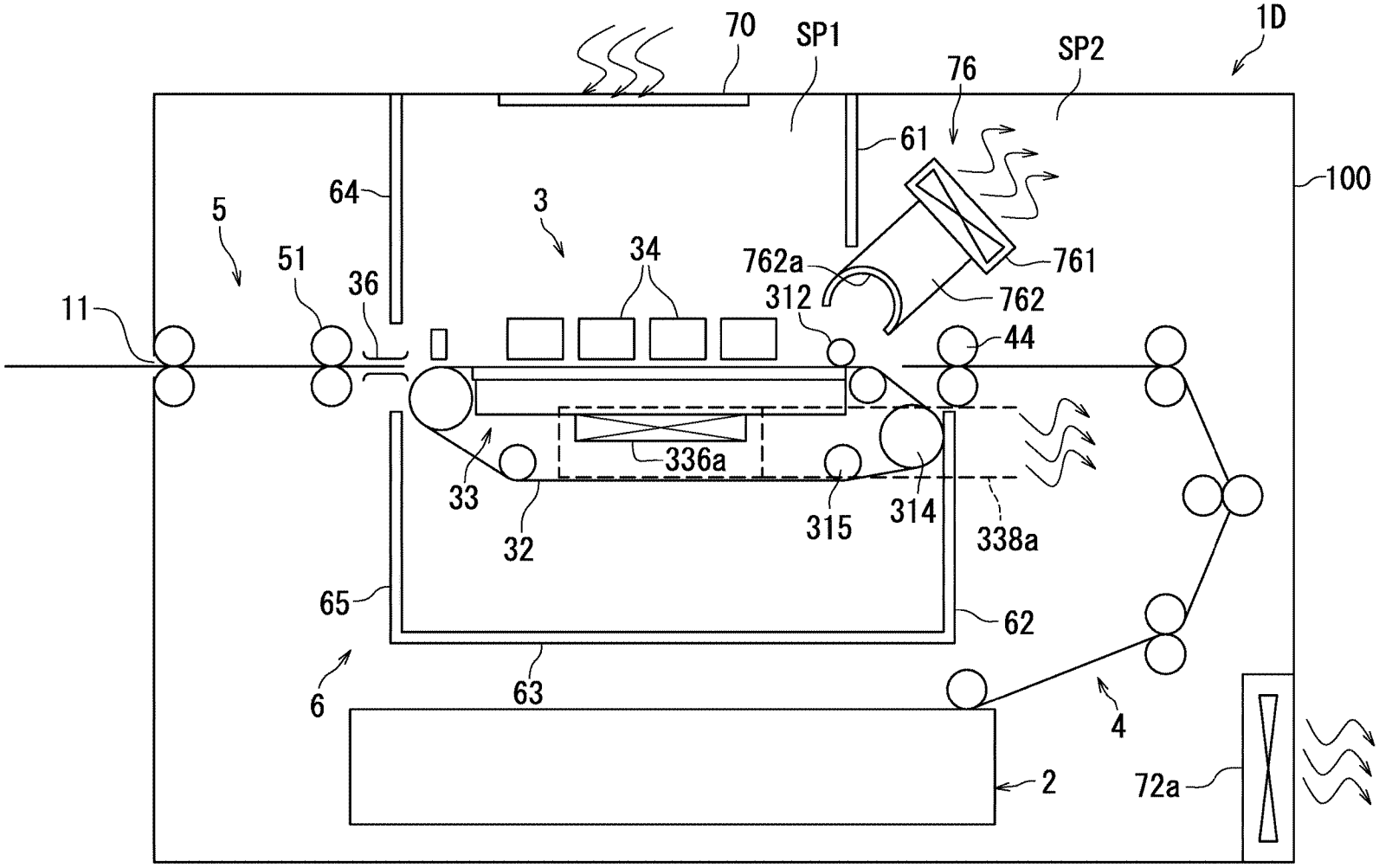
FIG. 12 is a side view illustrating an inkjet recording apparatus in FIG. 1 according to a fifth embodiment.

The following describes a configuration of the inkjet recording apparatus 1D according to a fifth embodiment with reference to FIG. 12. FIG. 12 is a side view illustrating the inkjet recording apparatus 1D in FIG. 1 according to the fifth embodiment. The inkjet recording apparatus 1D according to the fifth embodiment is different from the inkjet recording apparatus 1 according to the first embodiment in the following two aspects.

Difference G: A first air sucking and discharging section 76 sucks air around the placement roller 312 and discharges the air into the second space SP2.

Difference H: A duct 338*a* releases exhaust gas from a negative pressure creating section 336*a* into the second space SP2 through the second partition plate 62.

Elements of the inkjet recording apparatus 1D according to the fifth embodiment that are the same as those in the inkjet recording apparatus 1 according to the first embodiment illustrated in FIG. 6 are indicated by the same reference signs, and description thereof is not repeated. Description will be made below about elements of the inkjet recording apparatus 1D difference from those of the inkjet recording apparatus 1.

The duct 338*a* (first duct) releases exhaust gas from the negative pressure creating section 336*a* into the second space SP2. In FIG. 12, the duct 338*a* extends rightward through the second partition plate 62 from the negative pressure creating section 336*a* to the right side of the second partition plate 62. The duct 338*a* detours around the conveyor belt 32, the tension roller 314, and the pair of guide rollers 315 in front of (or behind) the drawing surface in FIG. 12 so as not to interfere with the conveyor belt 32, the tension roller 314, and the pair of guide rollers 315.

The first air sucking and discharging section 76 sucks air around the placement roller 312 and discharges the air into the second space SP2. The first air sucking and discharging section 76 includes a fan 761 and a duct 762. The fan 761 sucks air in the duct 762 and discharges the air into the second space SP2. The duct 762 forms an air flow path between the fan 761 and a vicinity of the placement roller 312 so as to allow the fan 761 to suck air around the placement roller 312. The duct 762 has an opening 762*a*.

A configuration in which the first air sucking and discharging section 76 discharges air into the second space SP2 is described with reference to FIG. 12. However, an alternative configuration can be employed. For example, the first air sucking and discharging section 76 may discharge air out of the apparatus casing 100. In the above configuration, a situation in which paper dust flows into the second space SP2 can be prevented. Accordingly, it can be ensured that a situation in which paper dust is attached to the recording heads 34 is prevented.

A second air sucking and discharging section 72*a* discharges air in the second space SP2 out of the apparatus casing 100. The second air sucking and discharging section 72*a* is disposed on a lower inner part of the right side wall of the apparatus casing 100.

A configuration in which the second air sucking and discharging section 72*a* is disposed on the lower inner part of the right side wall of the apparatus casing 100 has been described with reference to FIG. 12. However, the second air sucking and discharging section 72*a* may be disposed at another location. For example, the second air sucking and discharging section 72*a* may be disposed at a location on an upper wall (or side wall) of the apparatus casing 100 that is opposite to the fan 761 of the first air sucking and discharging section 76. In the above configuration, paper dust being attached to a sheet P at the placement roller 312 can be discharged out of the apparatus casing 100 further efficiently. In the following description, "paper dust being attached to a sheet P at the placement roller 312" includes both paper dust attached to a sheet P as a result of generation thereof at the placement roller 312 and paper dust attached to the sheet P as a result of generation thereof at a location upstream of the placement roller 312 in the conveyance direction of the sheet P.

As described above, the partition unit 6 partitions the interior of the apparatus casing 100 into the first and second spaces SP1 and SP2. Air from which dust is removed is taken into the first space SP1 from the outside of the apparatus casing 100 through the air inflow portion 70. Further, the first air sucking and discharging section 76 discharges into the second space SP2, paper dust being attached to a sheet P at the placement roller 312. In the above configuration, the first space SP1 can be kept clean with less paper dust contained. Accordingly, a situation in which paper dust is attached to the recording heads 34 can be prevented.

The duct 338*a* also releases exhaust gas from the negative pressure creating section 336*a* into the second space SP2. In the above configuration, paper dust collected by the negative pressure creating section 336 can be discharged into the second space SP2. Accordingly, it can be ensured that a situation in which paper dust is attached to the recording heads 34 is prevented.

The negative pressure creating section 336*a* includes a centrifugal fan 8 as illustrated in FIG. 9 for sucking air from above and discharging the air in front of (or behind or rightward in) the drawing surface in FIG. 12.

In the configuration in which the second air sucking and discharging section 72*a* discharges air in the second space SP2 out of the apparatus casing 100, paper dust in the second space SP2 can be discharged out of the apparatus casing 100. Therefore, even if air in the second space SP2 enters the first space SP1, a situation in which paper dust enters the first space SP1 can be prevented. Accordingly, it can be ensured that a situation in which paper dust is attached to the recording heads 34 is prevented.

Inkjet Recording Apparatus 1E According to Sixth Embodiment

Figure 13:
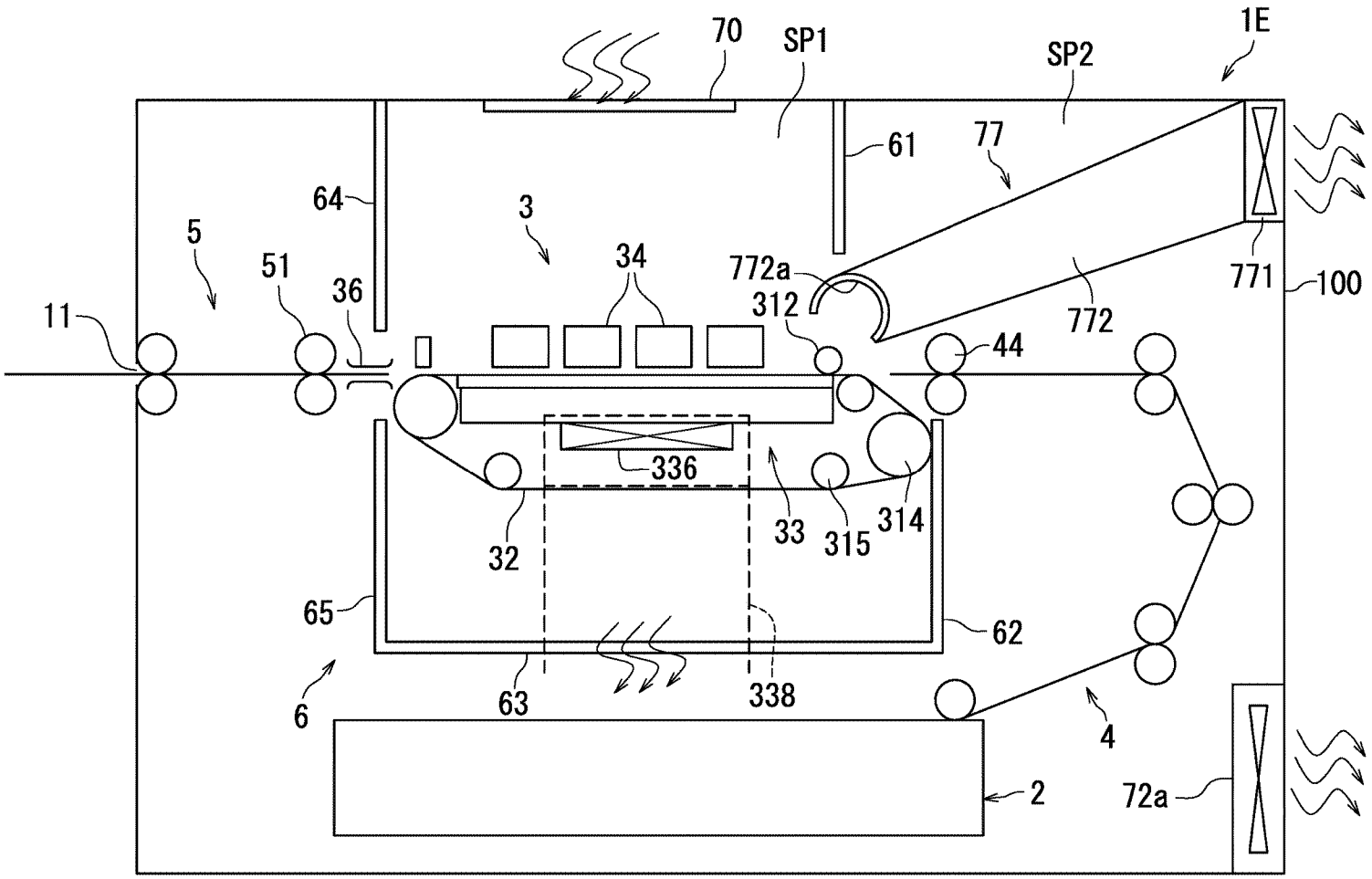
FIG. 13 is a side view illustrating an inkjet recording apparatus in FIG. 1 according to a sixth embodiment.

The following describes a configuration of the inkjet recording apparatus 1E according to a sixth embodiment with reference to FIG. 13. FIG. 13 is a side view illustrating the inkjet recording apparatus 1E in FIG. 1 according to the sixth embodiment. The inkjet recording apparatus 1E according to the sixth embodiment is different from the inkjet recording apparatus 1D according to the fifth embodiment in FIG. 12 in the following two aspects.

Difference I: A first air sucking and discharging section 77 discharges air around the placement roller 312 out of the apparatus casing 100.

Difference J: A duct 338 releases exhaust gas from the negative pressure creating section 336 below the third partition plate 63.

Elements of the inkjet recording apparatus 1E according to the sixth embodiment that are the same as those of the inkjet recording apparatus 1D according to the fifth embodiment illustrated in FIG. 12 are indicated by the same reference signs, and description thereof is not repeated. Description will be made below about elements of the inkjet recording apparatus 1E difference from those of the inkjet recording apparatus 1D. The inkjet recording apparatus 1E includes the duct 338 and the first air sucking and discharging section 77.

The duct 338 that is a first duct releases exhaust gas from the negative pressure creating section 336 into the second space SP2. The duct 338 extend downward through the third partition plate 63 from the negative pressure creating section 336 to a location above the sheet feed section 2. The duct 338 detours around the conveyor belt 32 in front of (or behind) the drawing surface in FIG. 13 so as not to interfere with the conveyor belt 32.

The first air sucking and discharging section 77 sucks air around the placement roller 312 and discharges the air out of the apparatus casing 100. The first air sucking and discharging section 77 includes a fan 771 and a duct 772. The fan 771 sucks air in the duct 772 and discharges the air out of the apparatus casing 100. The duct 772 forms an air flow path between the fan 771 and a vicinity of the placement roller 312 so as to allow the fan 771 to suck air around the placement roller 312. The duct 772 has an opening 772*a*.

In the above configuration, exhaust gas from the negative pressure creating section 336 is released into the second space SP2 through the duct 338. Through the above, paper dust collected by the negative pressure creating section 336 can be discharged into the second space SP2. Accordingly, it can be ensured that a situation in which paper dust is attached to the recording heads 34 is prevented.

Further, paper dust being attached to a sheet P at the placement roller 312 is discharged out of the apparatus casing 100 by the first air sucking and discharging section 77. Through the above, the first space SP1 can be kept clean with less paper dust contained. Accordingly, a situation in which paper dust is attached to the recording heads 34 can be prevented.

In the configuration in which the first air sucking and discharging section 77 discharges paper dust being attached to the sheet P at the placement roller 312 out of the apparatus casing 100, no paper dust is discharged into the second space SP2. Thus, an increase in paper dust remaining in the second space SP2 can be suppressed. Accordingly, a situation in which paper dust is attached to the recording heads 34 can be prevented.

Inkjet Recording Apparatus 1F According to Seventh Embodiment

Figure 14:
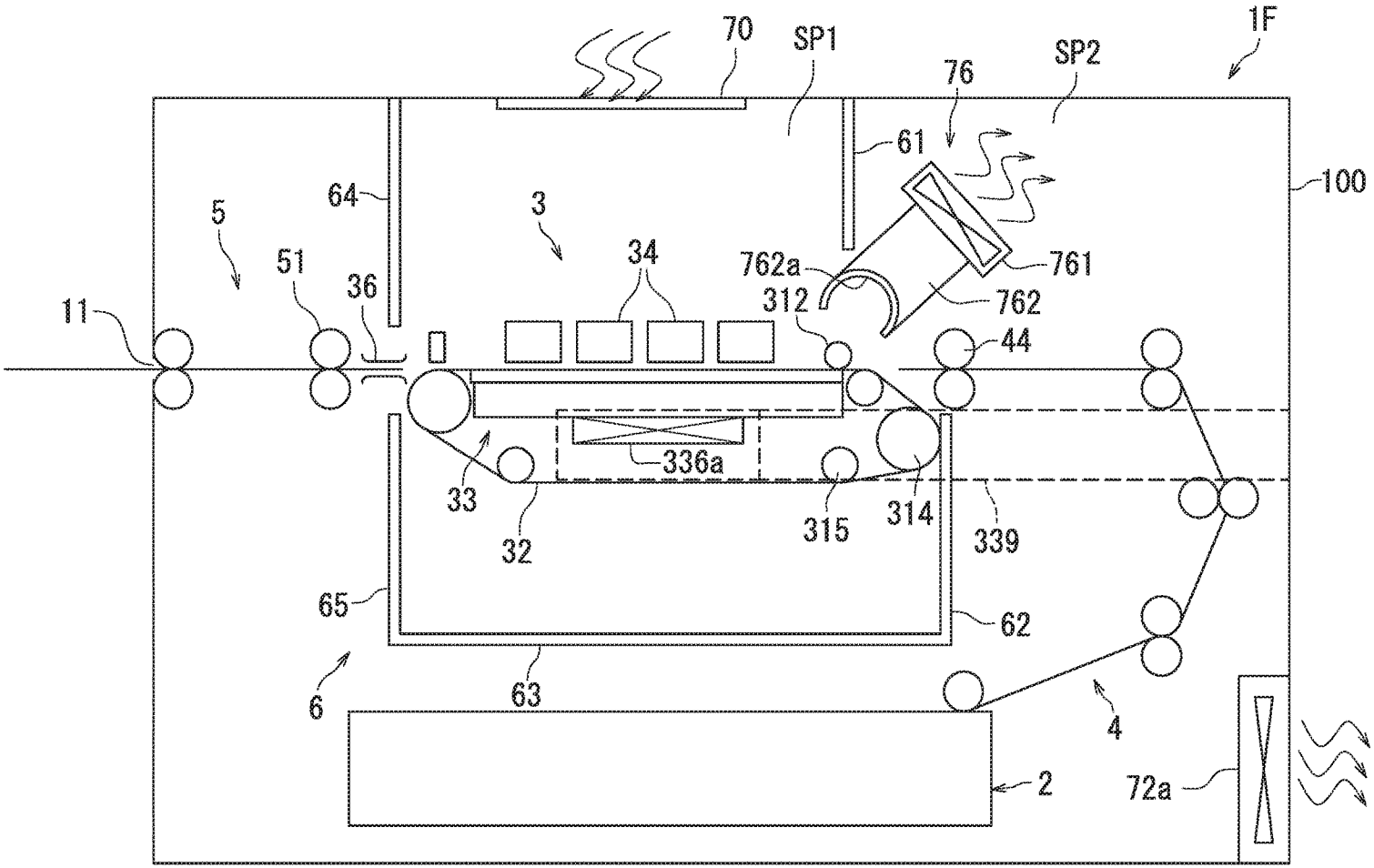
FIG. 14 is a side view illustrating an inkjet recording apparatus in FIG. 1 according to a seventh embodiment.

The following describes a configuration of an inkjet recording apparatus 1F according to a seventh embodiment with reference to FIG. 14. FIG. 14 is a side view illustrating the inkjet recording apparatus 1F in FIG. 1 according to the seventh embodiment. The inkjet recording apparatus 1F according to the seventh embodiment is different from the inkjet recording apparatus 1D according to the fifth embodiment in FIG. 12 in the following aspect.

Difference K: A duct 339 releases exhaust gas from a negative pressure creating section 336*a* out of the apparatus casing 100.

Elements of the inkjet recording apparatus 1F according to the seventh embodiment that are the same as those of the inkjet recording apparatus 1D according to the fifth embodiment illustrated in FIG. 12 are indicated by the same reference signs, and description thereof is not repeated. Description will be made below about elements of the inkjet recording apparatus 1F different from those of the inkjet recording apparatus 1D.

The duct 339 that is a first duct releases exhaust gas from the negative pressure creating section 336*a* out of the apparatus casing 100. The duct 339 extends rightward through the second partition plate 62 from the negative pressure creating section 336*a* to a right side wall of the apparatus casing 100. The duct 339 detours around the conveyor belt 32, the tension roller 314, and the pair of guide rollers 315 in front of (or behind) the drawing surface in FIG. 14 so as not to interfere with the conveyor belt 32, the tension roller 314, and the pair of guide rollers 315.

The negative pressure creating section 336*a* includes a centrifugal fan 8 as illustrated in FIG. 9 for sucking air from above and discharging the air rightward in FIG. 14.

Exhaust gas from the negative pressure creating section 336*a* is released out of the apparatus casing 100 through the duct 339. Through the above, paper dust collected by the negative pressure creating section 336 can be discharged out of the apparatus casing 100. Accordingly, it can be ensured that a situation in which paper dust is attached to the recording heads 34 is prevented.

Discharge of exhaust gas from the negative pressure creating section 336*a* out of the apparatus casing 100 can further ensure that a situation in which paper dust is attached to the recording heads 34 is prevented.

Exhaust gas from the negative pressure creating section 336*a* is not discharged into the second space SP2. In the above configuration, an increase in paper dust in the second space SP2 can be suppressed. Accordingly, even if air in the second space SP2 enters the first space SP1, it can be ensured that a situation in which paper dust is attached to the recording heads 34 can be prevented.

Inkjet Recording Apparatus 1G According to Eighth Embodiment

Figure 15:
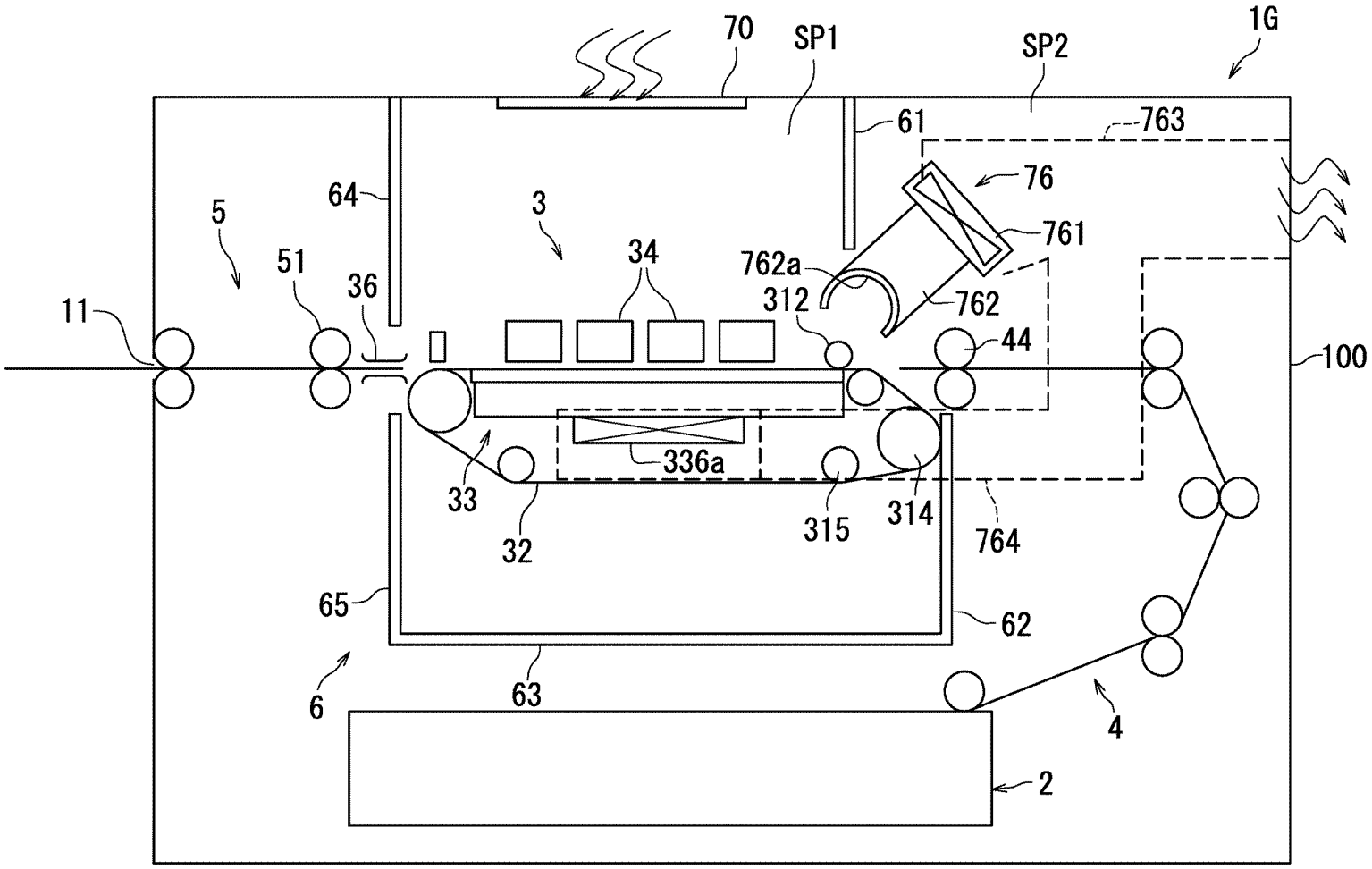
FIG. 15 is a side view illustrating an inkjet recording apparatus in FIG. 1 according to an eighth embodiment.

The following describes a configuration of an inkjet recording apparatus 1G according to an eighth embodiment with reference to FIG. 15. FIG. 15 is a side view illustrating the inkjet recording apparatus 1G in FIG. 1 according to the eighth embodiment. The inkjet recording apparatus 1G according to the eighth embodiment is different from the inkjet recording apparatus 1F according to the seventh embodiment in FIG. 14 in the following two aspects.

Difference L: A duct 763 releases exhaust gas from the first air sucking and discharging section 76 out of the apparatus casing 100.

Difference M: A duct 764 that releases exhaust gas from the negative pressure creating section 336*a* out of the apparatus casing 100 merges into the duct 763.

Elements of the inkjet recording apparatus 1G according to the eighth embodiment that are the same as those of the inkjet recording apparatus 1F according to the seventh embodiment illustrated in FIG. 14 are indicated by the same reference signs, and description thereof is not repeated. Description will be made below about elements of the inkjet recording apparatus 1G different from those of the inkjet recording apparatus 1F.

The duct 763 releases exhaust gas from the first air sucking and discharging section 76 out of the apparatus casing 100. The duct 763 extends from the first air sucking and discharging section 76 to the right side wall of the apparatus casing 100. The duct 763 releases exhaust gas from the first air sucking and discharging section 76 out of the apparatus casing 100 through the right side wall of the apparatus casing 100. The duct 763 corresponds to a second duct.

The duct 764 releases exhaust gas from the negative pressure creating section 336*a* out of the apparatus casing 100. The duct 764 merges into the duct 763 such that exhaust gas is discharged out of the apparatus casing 100 through a single exhaust port. The duct 764 corresponds to a first duct.

In the above configuration, air around an upper side of the placement roller 312 is sucked and discharged out of the apparatus casing 100 by the first air sucking and discharging section 76. Through the above, it can be ensured that paper dust being attached to a sheet P at the placement roller 312 is discharged out of the apparatus casing 100. Accordingly, it can be ensured that a situation in which paper dust is attached to the recording heads 34 is prevented.

Furthermore, the duct 764 merges into the duct 763 for discharge of exhaust gas through the single exhaust port. This can enable easy collection of paper dust discharged out of the apparatus casing 100 through the exhaust port.

A configuration in which the duct 764 merges into the duct 763 has been described with reference to FIG. 15. Alternatively, the duct 763 may merge into the duct 764.

Inkjet Recording Apparatus 1H According to Ninth Embodiment

Figure 16:
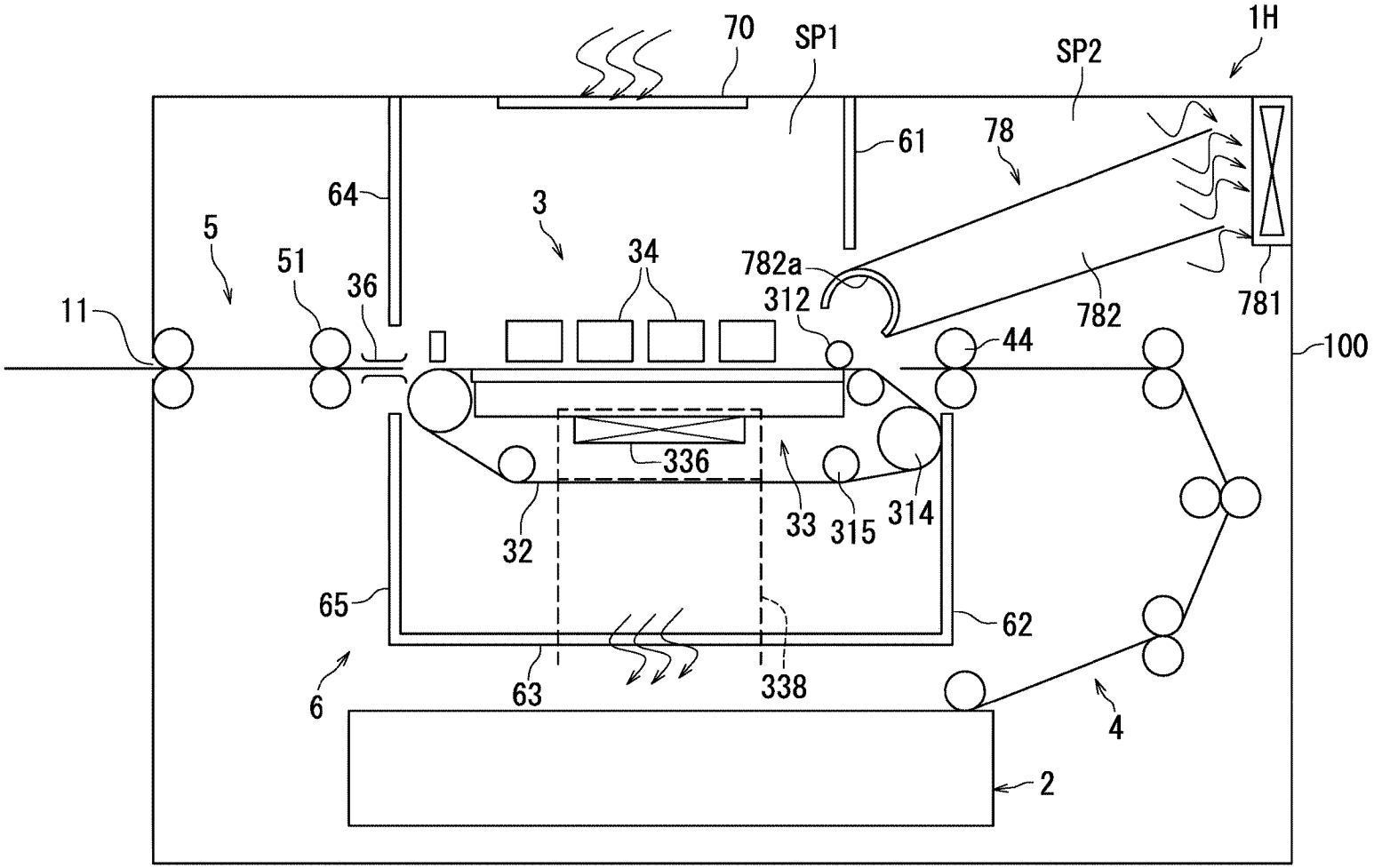
FIG. 16 is a side view illustrating an inkjet recording apparatus in FIG. 1 according to a ninth embodiment.

The following describes a configuration of an inkjet recording apparatus 1H according to a ninth embodiment with reference to FIG. 16. FIG. 16 is a side view illustrating the inkjet recording apparatus 1H in FIG. 1 according to the ninth embodiment. The inkjet recording apparatus 1H according to the ninth embodiment is different from the inkjet recording apparatus 1E according to the sixth embodiment in FIG. 13 in the following two aspects.

Difference N: A first air sucking and discharging section 78 sucks air around the placement roller 312 and in the second space SP2 and discharges the air out of the apparatus casing 100.

Deference P: The second air sucking and discharging section 72*a* is not provided.

Elements of the inkjet recording apparatus 1H according to the ninth embodiment that are the same as those of the inkjet recording apparatus 1E according to the sixth embodiment in FIG. 13 are indicated by the same reference signs, and description thereof is not repeated. Description will be made below about elements of the inkjet recording apparatus 1H different from those of the inkjet recording apparatus 1E.

The first air sucking and discharging section 78 sucks air around the placement roller 312 and in the second space SP2 and discharges the air out of the apparatus casing 100. The first air sucking and discharging section 78 includes a fan 781 and a duct 782. The fan 781 sucks air in the duct 742 and in the second space SP2 and discharges the air out of the apparatus casing 100. The duct 782 forms an air flow path between a vicinity of the fan 781 and a vicinity of the placement roller 312 so as to allow the fan 781 to suck air around the placement roller 312. The duct 782 has an opening 782*a*.

Paper dust being attached to a sheet P at the placement roller 312 is discharged out of the apparatus casing 100 by the first air sucking and discharging section 78. Through the above, the first space SP1 can be kept clean with less paper dust contained. Accordingly, a situation in which paper dust is attached to the recording heads 34 can be prevented.

In addition, the first air sucking and discharging section 78 discharges air in the second space SP2 out of the apparatus casing 100. As a result, paper dust in the second space SP2 is discharged out of the apparatus casing 100. Through the above, an increase in paper dust remaining in the second space SP2 can be suppressed. Accordingly, a situation in which paper dust is attached to the recording heads 34 can be prevented.

In the configuration in which the first air sucking and discharging section 78 discharges air around the placement roller 312 and in the second space SP2 out of the apparatus casing 100, it is unnecessary to provide the second air sucking and discharging section 72*a* for discharging air in the second space SP2 out of the apparatus casing 100. This can simplify the configuration of the inkjet recording apparatus 1H.

Embodiments of the present disclosure have been described so far with reference to the drawings. However, the present disclosure is not limited to the above embodiments and a wide range of alterations can be made to the embodiments so long as such alterations do not deviate from the intended scope of the present disclosure (for example, (1) to (5) below). The drawings are schematic illustrations that emphasize elements of configuration in order to facilitate understanding thereof. Therefore, in order that the elements can be easily illustrated in the drawings, properties of each of the elements, such as thickness, length, and number thereof, may differ from actual properties of the element. Further, the properties of each of the elements, such as shape and dimension thereof described in the above embodiments are mere examples and not limited specifically. The properties of the elements can be modified in various manners within the scope not substantially departing from the configuration of the present disclosure.

(1) The embodiments of the present disclosure describe a configuration in which the conveyor belt 32 conveys a sheet P in the image forming section 3. Alternatively, a sheet P may be conveyed in another method in the image forming section 3. For example, a sheet P may be conveyed by a plurality of conveyance rollers. In this variation, negative pressure is preferably applied through a gap between adjacent conveyance rollers.

(2) The embodiments of the present disclosure describe a configuration in which the partition unit 6 includes the first to fifth partition plates 61-65. However, it is only required that the first and second spaces SP1 and SP2 are separated from each other by the partition unit 6. For example, the second, third, and fifth partition plates 62, 63, and 65 may form a hemi-cylindrical shape in combination that protrudes downward. In the above configuration, the inkjet recording apparatus 1 (1A, 1B, 1C, 1D, 1E, 1F, 1G, and 1H) can be reduced in size.

(3) The embodiments of the present disclosure describe a configuration in which the first partition plate 61 extends to the upper wall of the apparatus casing 100 from a location above the placement roller 312. Alternatively, the first partition plate 61 may extends to the upper wall of the apparatus casing 100 from a location downstream of the placement roller 312 in the conveyance direction of the sheet P. In the above configuration, a situation in which paper dust generated at the placement roller 312 enters the first space SP1 can be prevented.

(4) The embodiments of the present disclosure describe a configuration in which the fourth partition plate 64 extends to the upper wall of the apparatus casing 100 from a location above the upstream end of the pair of conveyance guides 36 in the conveyance direction of the sheet P. Alternatively, the fourth partition plate 64 may extend to the upper wall of the apparatus casing 100 from a location upstream of the pair of conveyance guides 36 in the conveyance direction of a sheet P. In the above configuration, it can be ensured that a situation in which paper dust generated at the pair of conveyance guides 36 enters the first space SP1 is prevented. Accordingly, it can be ensured that a situation in which paper dust is attached to the recording heads 34 is prevented.

(5) The embodiments of the present disclosure describe a configuration in which the air inflow portion 70 includes a filter. Alternatively, the air inflow portion 70 may include a fan in addition. In the above configuration, an appropriate amount of air can be taken into the first space SP1 from the outside of the apparatus casing 100. However, the above configuration may increase internal pressure of the first or second space SP1 or SP2. For this reason, the amount of air discharged by the fan of the air inflow portion 70 is preferably balanced with that by the other fan(s) (for example, the fan of the second air sucking and discharging section 72).

What is claimed is:

1. An inkjet recording apparatus that forms an image by ejecting ink onto a recording medium, comprising:

an image forming section configured to form an image by ejecting ink onto the recording medium while conveying the recording medium;

a sheet feed section that stores therein the recording medium and that is configured to feed the stored recording medium;

a first sheet conveyance section configured to convey the recording medium fed from the sheet feed section toward the image forming section;

a second sheet conveyance section configured to convey the recording medium conveyed from the image forming section to eject the recording medium out of the inkjet recording apparatus;

a casing that houses the image forming section, the first sheet conveyance section, the second sheet conveyance section, and the sheet feed section;

a partition unit that partitions an interior of the casing into a first space in which the image forming section is disposed and a second space in which the sheet feed section, the first sheet conveyance section, and the second sheet conveyance section are disposed; and an air inflow portion through which air outside the casing is taken into the first space, wherein the second sheet conveyance section includes a conveyance guide disposed downstream of the image forming section in a conveyance direction of the recording medium, the image forming section includes a placement roller disposed in a vicinity of an upstream end of the image forming section in the conveyance direction of the recording medium, the inkjet recording apparatus further comprises a first air sucking and discharging section configured to suck air around the conveyance guide and discharge the air into the second space, the conveyance guide has an air hole penetrating the conveyance guide, and the first air sucking and discharging section sucks air around the conveyance guide through the air hole.

2. The inkjet recording apparatus according to claim 1, wherein the air inflow portion is located at an upper wall of the casing.

3. The inkjet recording apparatus according to claim 1, wherein the image forming section includes a negative pressure applying section configured to apply negative pressure to the recording medium, and the inkjet recording apparatus further comprises a duct configured to release exhaust gas from the negative pressure applying section into the second space or out of the casing.

4. The inkjet recording apparatus according to claim 3, wherein the negative pressure applying section includes a centrifugal fan.

5. An inkjet recording apparatus that forms an image by ejecting ink onto a recording medium, comprising:

an image forming section configured to form an image by ejecting ink onto the recording medium while conveying the recording medium;

a sheet feed section that stores therein the recording medium and that is configured to feed the stored recording medium;

a first sheet conveyance section configured to convey the recording medium fed from the sheet feed section toward the image forming section;

a second sheet conveyance section configured to convey the recording medium conveyed from the image forming section to eject the recording medium out of the inkjet recording apparatus;

a casing that houses the image forming section, the first sheet conveyance section, the second sheet conveyance section, and the sheet feed section;

a partition unit that partitions an interior of the casing into a first space in which the image forming section is disposed and a second space in which the sheet feed section, the first sheet conveyance section, and the second sheet conveyance section are disposed; and an air inflow portion through which air outside the casing is taken into the first space, wherein the second sheet conveyance section includes a conveyance guide disposed downstream of the image forming section in a conveyance direction of the recording medium, the image forming section includes a placement roller disposed in a vicinity of an upstream end of the image forming section in the conveyance direction of the recording medium, the inkjet recording apparatus further comprises a first air sucking and discharging section configured to suck air around the conveyance guide and discharge the air into the second space, and the conveyance guide includes a vibration applying section configured to apply vibration to the conveyance guide.

6. An inkjet recording apparatus that forms an image by ejecting ink onto a recording medium, comprising:

an image forming section configured to form an image by ejecting ink onto the recording medium while conveying the recording medium;

a sheet feed section that stores therein the recording medium and that is configured to feed the stored recording medium;

a first sheet conveyance section configured to convey the recording medium fed from the sheet feed section toward the image forming section;

a second sheet conveyance section configured to convey the recording medium conveyed from the image forming section to eject the recording medium out of the inkjet recording apparatus;

a casing that houses the image forming section, the first sheet conveyance section, the second sheet conveyance section, and the sheet feed section;

a partition unit that partitions an interior of the casing into a first space in which the image forming section is disposed and a second space in which the sheet feed section, the first sheet conveyance section, and the second sheet conveyance section are disposed; and an air inflow portion through which air outside the casing is taken into the first space, wherein the second sheet conveyance section includes a conveyance guide disposed downstream of the image forming section in a conveyance direction of the recording medium, the image forming section includes a placement roller disposed in a vicinity of an upstream end of the image forming section in the conveyance direction of the recording medium, the inkjet recording apparatus further comprises a first air sucking and discharging section configured to suck air around either or both the conveyance guide and the placement roller and discharge the air into the second space or out of the casing, and the conveyance guide includes a vibration applying section configured to apply vibration to the conveyance guide.

* * * * *